US012435284B2

(12) United States Patent
Xu et al.

(10) Patent No.: US 12,435,284 B2
(45) Date of Patent: Oct. 7, 2025

(54) FLUIDIZED CATALYTIC CONVERSION METHOD FOR PRODUCING LOW-CARBON OLEFINS FROM HYDROCARBONS

(71) Applicants: CHINA PETROLEUM & CHEMICAL CORPORATION, Beijing (CN); SINOPEC RESEARCH INSTITUTE OF PETROLEUM PROCESSING CO., LTD., Beijing (CN)

(72) Inventors: Youhao Xu, Beijing (CN); Yanfen Zuo, Beijing (CN); Xin Wang, Beijing (CN); Mingyuan He, Beijing (CN); Youxin Sha, Beijing (CN); Xuhui Bai, Beijing (CN)

(73) Assignees: CHINA PETROLEUM & CHEMICAL CORPORATION, Beijing (CN); SINOPEC RESEARCH INSTITUTE OF PETROLEUM PROCESSING CO., LTD., Beijing (CN)

( * ) Notice: Subject to any disclaimer, the term of this patent is extended or adjusted under 35 U.S.C. 154(b) by 274 days.

(21) Appl. No.: 18/260,707

(22) PCT Filed: Jun. 24, 2021

(86) PCT No.: PCT/CN2021/101927
§ 371 (c)(1),
(2) Date: Jul. 7, 2023

(87) PCT Pub. No.: WO2022/147972
PCT Pub. Date: Jul. 14, 2022

(65) Prior Publication Data

US 2024/0059989 A1 Feb. 22, 2024

(30) Foreign Application Priority Data

Jan. 11, 2021 (CN) ..... 202110031551.4
Mar. 5, 2021 (CN) ..... 202110245789.7
Mar. 19, 2021 (CN) ..... 202110296896.2

(51) Int. Cl.
*C10G 69/04* (2006.01)

(52) U.S. Cl.
CPC ..... *C10G 69/04* (2013.01); *C10G 2300/1088* (2013.01); *C10G 2300/4006* (2013.01);
(Continued)

(58) Field of Classification Search
CPC ..... C10G 69/04; C10G 2300/1088; C10G 2300/4006; C10G 2300/4012;
(Continued)

(56) References Cited

U.S. PATENT DOCUMENTS 4,422,925 A * 12/1983 Williams ..... C10G 11/182 208/74
9,550,708 B2 1/2017 Mandal et al.
(Continued)

FOREIGN PATENT DOCUMENTS

CN 1078094 C 1/2002
CN 101062885 A 10/2007
(Continued)

OTHER PUBLICATIONS

CN 101531558 translation (Year: 2009).*
(Continued)

*Primary Examiner* — Randy Boyer
*Assistant Examiner* — Juan C Valencia
(74) *Attorney, Agent, or Firm* — NKL Law; Allen Xue

(57) ABSTRACT

A fluidized catalytic conversion method for producing light olefins from hydrocarbons, includes the steps of conducting
(Continued)

catalytic conversion of an olefin-rich feedstock in a first reaction zone of a fluidized catalytic conversion reactor, contacting a heavy feedstock with the reaction stream from the first reaction zone in a second reaction zone of the reactor for reaction, separating the effluent from the reactor, and recycling the resulting olefin-rich stream to the first reaction zone for further reaction. The method can improve the utilization rate of petrochemical resources and shows high yield and selectivity of ethylene, propylene and butylene.

19 Claims, 3 Drawing Sheets

(52) U.S. Cl.
CPC ..... *C10G 2300/4012* (2013.01); *C10G 2300/4081* (2013.01); *C10G 2400/20* (2013.01)

(58) Field of Classification Search
CPC ..... C10G 2300/4081; C10G 2400/20; C10G 11/05; C10G 11/18; C10G 51/026; C10G 69/02; C10G 11/187; C10G 11/02; C10G 11/182; C10G 49/04
See application file for complete search history.

(56) References Cited

U.S. PATENT DOCUMENTS

| | | | | |
|---|---|---|---|---|
| 2011/0073523 | A1* | 3/2011 | Cui | C10G 11/05 208/68 |
| 2016/0333280 | A1 | 11/2016 | Subramani et al. | |

FOREIGN PATENT DOCUMENTS

| | | | | |
|---|---|---|---|---|
| CN | 101081801 | A | | 12/2007 |
| CN | 101092323 | A | | 12/2007 |
| CN | 101239878 | A | | 8/2008 |
| CN | 101531558 | A | * | 9/2009 |
| CN | 101760228 | A | | 6/2010 |
| CN | 107597026 | A | | 1/2018 |
| CN | 110724560 | A | | 1/2020 |
| CN | 110951501 | A | | 4/2020 |

OTHER PUBLICATIONS

Pan, Shuyu et al.; "Feeding Methanol in an FCC Unit"; Petroleum Science and Technology; vol. 26, No. 2; Jan. 30, 2008; ISSN: 1091-6466; pp. 170-180.

* cited by examiner

FLUIDIZED CATALYTIC CONVERSION METHOD FOR PRODUCING LOW-CARBON OLEFINS FROM HYDROCARBONS

CROSS REFERENCE TO RELATED APPLICATIONS

This application is a U.S. national stage entry of PCT international application PCT/CN2021/101927, filed on Jun. 24, 2021, which claims the priority of Chinese patent application No. 202110031551.4, titled "a catalytic conversion method for preparing ethylene, propylene and butylene", filed on Jan. 11, 2021, the priority of Chinese patent application No. 202110245789.7, titled "a catalytic conversion method for maximizing the production of ethylene with co-production of propylene", filed on Mar. 5, 2021, and the priority of Chinese patent application No. 202110296896.2, titled "a catalytic conversion method for preparing light olefins", filed on Mar. 19, 2021, the contents of each is incorporated herein by reference in its entirety.

TECHNICAL FIELD

The present application relates to the technical field of fluidized catalytic conversion, particularly to a fluidized catalytic conversion method for preparing light olefins from hydrocarbons.

BACKGROUND ART

Olefins having four or less carbon atoms are important chemical raw materials, and typical products include: ethylene, propylene and butylene. On the one hand, with the continuous and accelerated development of economy, the demand of various industries on light oil products and clean fuel oil is also rapidly increased. On the other hand, with the increasing of the oil field exploitation amount, the available yield of conventional crude oil is gradually reduced, the quality of crude oil is becoming poor and tends to be deteriorated and heavy. Although the production capacity of light olefins in China is rapidly increased, the demand of the domestic market for light olefins still cannot be met at present.

The main products produced from ethylene include polyethylene, ethylene oxide, ethylene glycol, polyvinyl chloride, styrene, vinyl acetate and the like. The main products produced from propylene include acrylonitrile, propylene oxide, acetone and the like; the main products produced from butylene include butadiene, and butylene is further used for producing methyl ethyl ketone, sec-butyl alcohol, butylene oxide and butylene polymers and copolymers, and the main products produced from isobutylene include butyl rubber, polyisobutylene rubber and various plastics. Accordingly, there is an increasing demand for ethylene, propylene and butylene, which are used for producing various important organic chemicals, synthetic resins, synthetic rubbers, various fine chemicals, and the like.

The petroleum route adopts the traditional way for preparing ethylene and propylene by steam cracking, of which the demand for light hydrocarbons such as naphtha and the like is large, and it is expected that 70 million tons of light chemical oil will be needed in 2025 years. The domestic crude oil is normally heavy, and the light chemical oil cannot meet the requirements for producing ethylene, propylene and butylene raw materials. The steam cracking raw materials mainly include light hydrocarbons (such as ethane, propane and butane), naphtha, diesel oil, condensate oil and hydrogenated tail oil, among which the mass fraction of naphtha accounts for more than 50%. Typical naphtha steam cracking has an ethylene yield of about 29-34%, a propylene yield of 13-16%, and the lower ethylene/propylene output ratio is difficult to meet the current situation of light olefins demand.

CN101092323A discloses a method for preparing ethylene and propylene from a mixture of C4-C8 olefins, comprising reacting at a reaction temperature of 400-600° C. and an absolute pressure of 0.02-0.3 MPa, and recycling 30-90 wt % of the C4 fraction to the reactor after separating in a separator for further cracking. The method improves the conversion rate of the olefin mainly by recycling the C4 fraction, the ethylene and propylene obtained account for not less than 62% of the total amount of the olefin feedstock, but it suffers from the problems of relatively low ethylene/propylene ratio, which cannot be flexibly adjusted according to market demands, and low reaction selectivity.

CN101239878A discloses a method using a mixture rich in C4+ olefins as a raw material, comprising reacting at a reaction temperature of 400-680° C., a reaction pressure of −0.09 MPa to 1.0 MPa and a weight space velocity of 0.1 to 50 $h^{-1}$, the resulting product has an ethylene/propylene ratio of lower than 0.41, and as the temperature rises, the ethylene/propylene ratio increases, and the production of hydrogen, methane and ethane increases.

Non-petroleum route mainly includes a process for producing light olefins mainly comprising ethylene and propylene by using oxygen-containing organic compounds, typically methanol or dimethyl ether, as raw materials, which is called MTO for short. Methanol or dimethyl ether is a typical oxygen-containing organic compound, the reaction for producing light olefins from which has the characteristics of rapid reaction, strong heat release, low catalyst-to-alcohol ratio and long reaction induction period, and rapid deactivation of catalyst is a major challenge of the MTO process. How to solve the problems of long reaction induction period, easy deactivation of catalyst and the like in the MTO process in a scientific and efficient way is a subject always lies ahead the majority of scientific researchers and engineers.

Therefore, in the new stage of the transforming of oil refining enterprises into integrated power center of oil refining and chemical engineering, a brand new catalytic conversion mode is urgently needed in the field, which integrates multiple catalytic conversion reaction modes, and can improve the yield of high-value light olefins, namely ethylene and propylene, and the selectivity of ethylene and propylene.

SUMMARY OF THE INVENTION

An object of the present application is to provide a fluidized catalytic conversion method for preparing light olefins (such as ethylene, propylene and butylene) from hydrocarbons, which can significantly improve the yield and selectivity of ethylene, propylene and butylene.

To achieve the above object, the present application provides a fluidized catalytic conversion method for preparing light olefins from hydrocarbons, comprising the steps of:

1) introducing an olefin-rich feedstock into a first reaction zone of a fluidized catalytic conversion reactor, contacting with a catalytic conversion catalyst having a temperature of 650° C. or higher, and reacting under first catalytic conversion conditions, wherein the olefin-rich feedstock has an olefin content of 50 wt % or more;

2) introducing a heavy feedstock into a second reaction zone of the fluidized catalytic conversion reactor downstream of the first reaction zone, contacting with the catalytic conversion catalyst from the first reaction zone after the reaction of step 1), and reacting under second catalytic conversion conditions;

3) separating the effluent of the fluidized catalytic conversion reactor to obtain reaction products and a spent catalyst, and carrying out a first separation on the reaction products to obtain ethylene, propylene, butylene, first catalytic cracking distillate oil and second catalytic cracking distillate oil; the initial boiling point of the first catalytic cracking distillate oil is in a range of more than 20° C. to less than 140° C., the final boiling point of the second catalytic cracking distillate oil is in a range of more than 250° C. to less than 550° C., and the cut point between the first catalytic cracking distillate oil and the second catalytic cracking distillate oil is in a range of 140° C. to 250° C.;

4) carrying out a second separation on the first catalytic cracking distillate oil to obtain an olefin-rich stream having a C5+ olefin content of at least 50 wt %; and 5) recycling at least a part of the olefin-rich stream to step 1) for further reaction, wherein the first catalytic conversion conditions include:

a reaction temperature of 600-800° C., preferably 630-780° C.;

a reaction pressure of 0.05-1 MPa, preferably 0.1-0.8 MPa;

a reaction time of 0.01-100 seconds, preferably 0.1-80 seconds;

a weight ratio of the catalytic conversion catalyst to the olefin-rich feedstock of (1-200):1, preferably (3-180):1; and the second catalytic conversion conditions include:

a reaction temperature of 400-650° C., preferably 450-600° C.;

a reaction pressure of 0.05-1 MPa, preferably 0.1-0.8 MPa;

a reaction time of 0.01-100 seconds, preferably 0.1-80 seconds;

a weight ratio of the catalytic conversion catalyst to the heavy feedstock of (1-100):1, preferably (3-70):1.

optionally, the method may further comprise one or more of the following steps 6), 7) and 2a):

6) contacting the second catalytic cracking distillate oil with a hydrogenation catalyst for reaction under hydrogenation conditions to obtain a hydrogenated catalytic cracking distillate oil, and recycling the hydrogenated catalytic cracking distillate oil to the fluidized catalytic conversion reactor for further reaction;

7) recycling at least a part of the butylene separated in step 3) to the catalytic conversion reactor upstream of the position at which the olefin-rich feedstock is introduced to contact with the catalytic conversion catalyst and react under third catalytic conversion conditions including:

a reaction temperature of 650-800° C., preferably 680-780° C., a reaction pressure of 0.05-1 MPa, preferably 0.1-0.8 MPa, a reaction time of 0.01-10 seconds, preferably 0.05-8 seconds, a weight ratio of the catalytic conversion catalyst to the butylene of (20-200):1, preferably (30-180):1; and 2a) introducing an oxygen-containing organic compound into the second reaction zone of the fluidized catalytic conversion reactor to contact with the catalytic conversion catalyst therein for reaction under fourth catalytic conversion conditions including:

a reaction temperature of 300-550° C., preferably 400-530° C., a reaction pressure of 0.01-1 MPa, preferably 0.05-1 MPa, a reaction time of 0.01-100 seconds, preferably 0.1-80 seconds, a weight ratio of the catalytic conversion catalyst to the oxygen-containing organic compound feedstock of (1-100):1, preferably (3-50):1.

In the fluidized catalytic conversion method of the present application, an olefin-rich feedstock is subjected to catalytic cracking in a first reaction zone of a fluidized catalytic conversion reactor, then a heavy feedstock is contacted with the mixed stream from the first reaction zone in a second reaction zone for catalytic cracking reaction, and the reaction product is subjected to first separation and second separation, the resulting olefin-rich stream may be used for catalytic cracking again, and the olefin-containing fraction in the reaction product is used for further production of light olefins, so that the utilization rate of petrochemical resources may be improved; in the present application, the heavy feedstock is introduced into the production process, so that the use of heavy oil can be achieved, and the cost can be reduced; the fluidized catalytic conversion method for producing light olefins of the present application shows higher yield and selectivity of ethylene, propylene and butylene; and the yields of benzene, toluene and xylene are also improved.

Other characteristics and advantages of the present application will be described in detail in the detailed description hereinbelow.

BRIEF DESCRIPTION OF THE DRAWINGS

The drawings, forming a part of the present description, are provided to help the understanding of the present application, and should not be considered to be limiting. The present application may be interpreted with reference to the drawings in combination with the detailed description hereinbelow. In the drawings.

BRIEF DESCRIPTION OF THE REFERENCE NUMERALS

Figure 1:
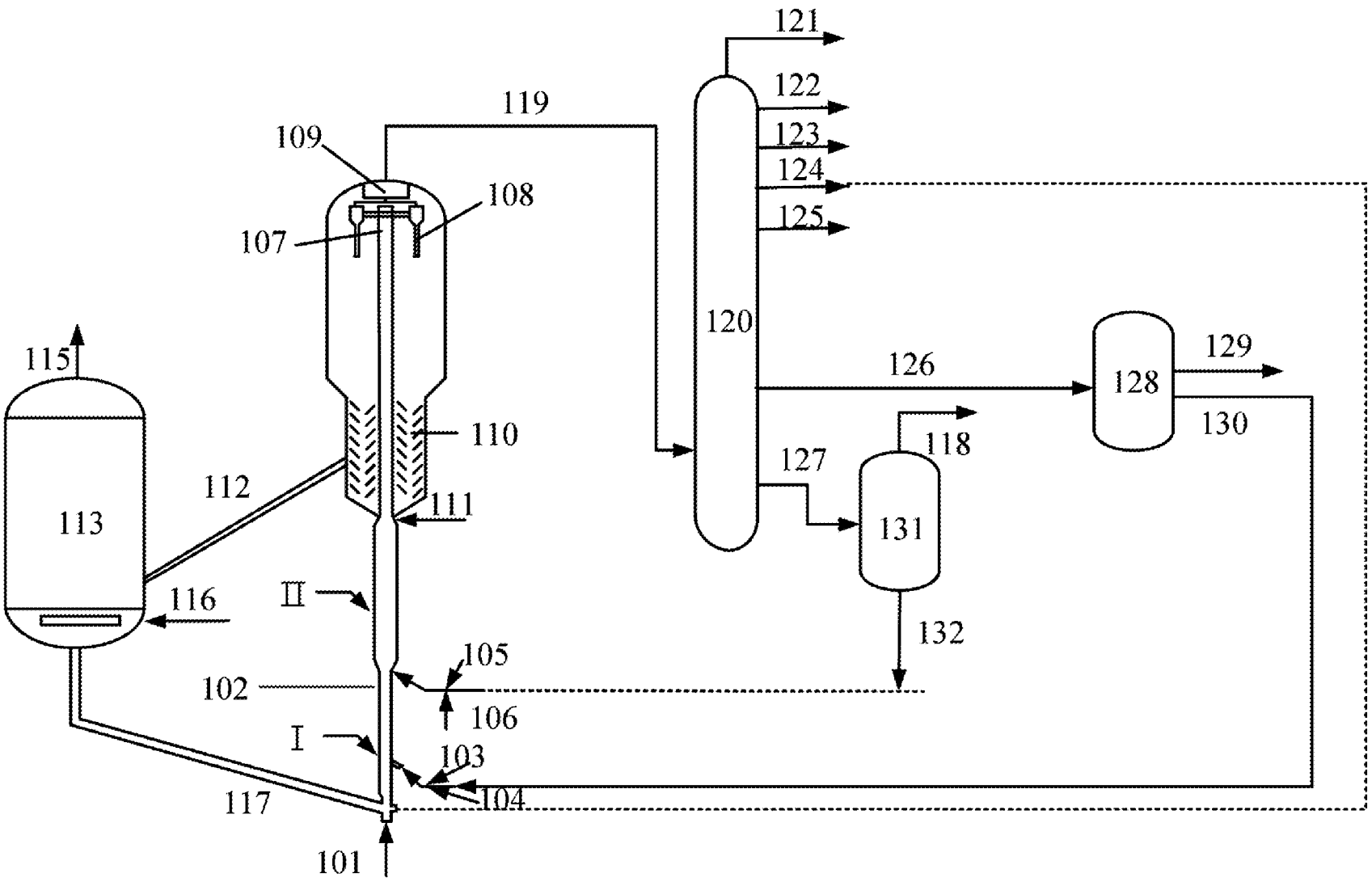
FIG. 1 shows a schematic flow diagram of a preferred embodiment of the fluidized catalytic conversion method of the present application.

| | |
|---|---|
| I | first reaction zone |
| II | second reaction zone |
| III | third reaction zone |
| 101 | pipeline |
| 102 | reactor |
| 103 | pipeline |
| 104 | pipeline |
| 105 | pipeline |
| 106 | pipeline |
| 107 | outlet section |
| 108 | cyclone separator |

-continued 109 plenum chamber
110 stripping section
111 pipeline
112 standpipe
113 regenerator
115 pipeline
116 pipeline
117 pipeline
118 pipeline
119 reactor vapor line
120 fractionator
121 pipeline
122 pipeline
123 pipeline
124 pipeline
125 pipeline
126 pipeline
127 pipeline
128 olefin separator
129 pipeline
130 pipeline
131 hydrotreater
132 pipeline
201 pipeline
202 reactor
203 pipeline
204 pipeline
205 pipeline
206 pipeline
207 outlet section
208 cyclone separator
209 plenum chamber
210 stripping section
211 pipeline
212 standpipe
213 regenerator
215 pipeline
216 pipeline
217 pipeline
218 pipeline
219 reactor vapor line
220 fractionator
221 pipeline
222 pipeline
223 pipeline
224 pipeline
225 pipeline
226 pipeline
227 pipeline
228 olefin separator
229 pipeline
230 pipeline
231 pipeline
232 hydrotreater
233 pipeline
301 pipeline
302 reactor
303 pipeline
304 pipeline
305 pipeline
306 pipeline
307 pipeline
308 outlet section
309 cyclone separator
310 plenum chamber
311 stripping section
312 pipeline
313 standpipe
314 regenerator
315 pipeline
316 pipeline
317 pipeline
318 pipeline
319 reactor vapor line
320 fractionator
321 pipeline
322 pipeline
323 pipeline
324 pipeline -continued 325 pipeline
326 pipeline
327 pipeline
328 pipeline
329 olefin separator
330 pipeline
331 pipeline
332 hydrotreater
333 pipeline

DETAILED DESCRIPTION OF THE INVENTION

The present application will be further described hereinafter in detail with reference to the drawing and specific embodiments thereof. It should be noted that the specific embodiments of the present application are provided for illustration purpose only, and are not intended to be limiting in any manner.

Any specific numerical value, including the endpoints of a numerical range, described in the context of the present application is not restricted to the exact value thereof, but should be interpreted to further encompass all values close to the exact value, for example all values within ±5% of the exact value. Moreover, regarding any numerical range described herein, arbitrary combinations can be made between the endpoints of the range, between each endpoint and any specific value within the range, or between any two specific values within the range, to provide one or more new numerical range(s), where the new numerical range(s) should also be deemed to have been specifically described in the present application.

Unless otherwise stated, the terms used herein have the same meaning as commonly understood by those skilled in the art; and if the terms are defined herein and their definitions are different from the ordinary understanding in the art, the definition provided herein shall prevail.

In the context of the present application, the expression "C5+" means having at least 5 carbon atoms, for example the term "C5+ olefins" refers to olefins having at least 5 carbon atoms, while the term "C5+ fraction" refers to a fraction of which the compounds have at least carbon atoms.

In the context of the present application, in addition to those matters explicitly stated, any matter or matters not mentioned are considered to be the same as those known in the art without any change. Moreover, any of the embodiments described herein can be freely combined with another one or more embodiments described herein, and the technical solutions or ideas thus obtained are considered as part of the original disclosure or original description of the present application, and should not be considered to be a new matter that has not been disclosed or anticipated herein, unless it is clear to the person skilled in the art that such a combination is obviously unreasonable.

All of the patent and non-patent documents cited herein, including but not limited to textbooks and journal articles, are hereby incorporated by reference in their entirety.

As described above, the present application provides a fluidized catalytic conversion method for producing light olefins from hydrocarbons, comprising the steps of:

1) introducing an olefin-rich feedstock into a first reaction zone of a fluidized catalytic conversion reactor, and contacting with a catalytic conversion catalyst having a temperature of 650° C. or higher for reaction, wherein the olefin-rich feedstock has an olefin content of 50 wt % or more;

2) introducing a heavy feedstock into a second reaction zone of the fluidized catalytic conversion reactor downstream of the first reaction zone to contact with the catalytic conversion catalyst from the first reaction zone after the reaction of step 1) for reaction;

3) separating the effluent of the fluidized catalytic conversion reactor to obtain reaction product vapor and a spent catalyst, and carrying out a first separation on the reaction product vapor to obtain ethylene, propylene, butylene, first catalytic cracking distillate oil and second catalytic cracking distillate oil; the initial boiling point of the first catalytic cracking distillate oil is in a range of more than 20° C. to less than 140° C., the final boiling point of the second catalytic cracking distillate oil is in a range of more than 250° C. to less than 550° C., and the cut point between the first catalytic cracking distillate oil and the second catalytic cracking distillate oil is in a range of 140° C. to 250° C.;

4) carrying out a second separation on the first catalytic cracking distillate oil to obtain an olefin-rich stream having a C5+ olefin content of at least 50 wt %; and 5) recycling at least a part of the olefin-rich stream to step 1) for further reaction.

The inventors of the present application have surprisingly found, through a large number of catalytic cracking tests on alkanes and olefins, that, by respectively reacting olefins and alkanes under the same catalytic cracking conditions, the yield and selectivity of light olefins produced by cracking of olefins are significantly superior to that of alkanes; and the difference in product distribution of catalytic cracking of olefins and alkanes is also significant, thereby arriving at the technical solution of the present application.

In a preferred embodiment, the reaction of step 1) is carried out under first catalytic conversion conditions including:

- a reaction temperature of 600-800° C., preferably 630-780° C.;
- a reaction pressure of 0.05-1 MPa, preferably 0.1-0.8 MPa;
- a reaction time of 0.01-100 seconds, preferably 0.1-80 seconds;
- a weight ratio of the catalytic conversion catalyst to the olefin-rich feedstock of (1-200):1, preferably (3-180):1.

In a preferred embodiment, the reaction of step 2) is carried out under second catalytic conversion conditions including:

- a reaction temperature of 400-650° C., preferably 450-600° C.;
- a reaction pressure of 0.05-1 MPa, preferably 0.1-0.8 MPa;
- a reaction time of 0.01-100 seconds, preferably 0.1-80 seconds;
- a weight ratio of the catalytic conversion catalyst to the heavy feedstock of (1-100):1, preferably (3-70):1.

In a preferred embodiment, the olefin-rich feedstock employed herein has an olefin content of 80 wt % or more, preferably 90 wt % or more; more preferably, the olefin-rich feedstock is a pure olefin feedstock. The inventors of the present application have found during research that the increasing of the olefin content in the olefin-rich feedstock is beneficial to the improvement of the yield and selectivity of light olefins in the product, and even better effects can be obtained using C5+ olefins.

In a preferred embodiment, the olefins in the olefin-rich feedstock consist essentially of C5+ olefins, e.g. 80% or more, 85% or more, 90% or more, or 95% or more of the olefins, more preferably 100% of the olefins, in the olefin-rich feedstock are C5+ olefins.

In the present application, the olefin-rich feedstock may come from a variety of sources, and there is no particular limitation thereto. In some embodiments, the olefin-rich feedstock may be derived only from a stream comprising C5+ olefins separated from the catalytic conversion product of heavy oil feedstocks, i.e., the olefin-rich feedstock may be the olefins recycled in the system; in other embodiments, the olefin-rich feedstock may comprise an external olefin feedstock in addition to the above-described stream comprising C5+ olefins, with no particular limitation to the amount of the external olefin feedstock.

In some embodiments, the olefin-rich feedstock used in step 1) may be derived from any one or more of the following sources: a C5+ fraction produced by an alkane dehydrogenation unit, a C5+ fraction produced by a catalytic cracking unit in an oil refinery, a C5+ fraction produced by a steam cracking unit in an ethylene plant, and an olefin-rich C5+ byproduct fraction of MTO (methanol to olefin) and MTP (methanol to propylene) processes and the like. In a preferred embodiment, the alkane feedstock for the alkane dehydrogenation unit may be derived from at least one of naphtha, aromatic raffinate, and/or other light hydrocarbons. In actual production, the alkane product from other petrochemical plants may also be used.

In some embodiments, the olefin-rich feedstock used herein is obtainable by contacting an alkane with a dehydrogenation catalyst in a dehydrogenation reactor under catalytic dehydrogenation conditions, wherein the dehydrogenation conditions used include: an inlet temperature of the dehydrogenation reactor of 400-700° C., a volume space velocity of alkane of 500-5000 and a reaction pressure of 0.04-1.1 bar.

Preferably, the dehydrogenation catalyst consists of a carrier and an active component and a promoter that are supported on the carrier; based on the total weight of the dehydrogenation catalyst, the carrier is present in an amount of 60-90 wt %, the active component is present in an amount of 8-35 wt %, and the promoter is present in an amount of 0.1-5 wt %.

Further preferably, the carrier may be an alumina comprising a modifier; wherein, based on the total weight of the dehydrogenation catalyst, the content of the modifier is 0.1-2 wt %, and the modifier may be La and/or Ce; the active component may be platinum and/or chromium; the promoter may be a composition of bismuth and an alkali metal component or a composition of bismuth and an alkaline earth metal component, wherein the molar ratio of bismuth to the active component is 1:(5-50), and the molar ratio of bismuth to the alkali metal component is 1:(0.1-5), the molar ratio of bismuth to the alkaline earth metal component is 1:(0.1-5). Particularly preferably, the alkali metal component may be one or more selected from of Li, Na and K; the alkaline earth metal component may be one or more selected from of Mg, Ca and Ba.

In some preferred embodiments, the fluidized catalytic conversion method of the present application further comprises the steps of:

6) contacting the second catalytic cracking distillate oil with a hydrogenation catalyst for reaction under hydrogenation conditions to obtain a hydrogenated catalytic cracking distillate oil, and recycling the hydrogenated catalytic cracking distillate oil to the fluidized catalytic conversion reactor for further reaction. In this embodiment, the reaction product of the catalytic gas oil is subjected to hydrotreatment and then introduced into the fluidized catalytic conversion reactor again for further reaction, so that the utilization rate of the raw materials can be improved, and the yield of ethylene, propylene and butylene can be increased.

Preferably, the hydrogenated catalytic cracking distillate oil is recycled to the second reaction zone of the fluidized catalytic conversion reactor for further reaction. In this embodiment, saturated hydrocarbons with relatively higher carbon number contained in the hydrogenated catalytic cracking distillate oil may be cracked into C5-C9 olefins first in the second reaction zone under relatively mild reaction conditions; the resulting olefins are then recycled in step 5) along with the olefin-rich stream to the first reaction zone of the reactor, where they are cracked again at a high temperature, thereby further increasing the ethylene yield.

According to the present application, the hydrogenation conditions of step 6) may be those commonly used in the art, and are not strictly limited herein. In a further preferred embodiment, the conditions for the reaction of the second catalytic cracking distillate oil and the hydrogenation catalyst may include: a hydrogen partial pressure of 3.0-20.0 MPa, a reaction temperature of 300-450° C., a hydrogen-to-oil volume ratio of 300-2000, and a volume space velocity of 0.1-3.0 $h^{-1}$.

According to the present application, the hydrogenation catalyst used in step 6) may be those commonly used in the art, which is not strictly limited herein. For example, the hydrogenation catalyst may comprise a carrier and a metal component and optionally an additive supported on the carrier. Preferably, the hydrogenation catalyst comprises 20-90 wt % of a carrier, 10-80 wt % of a supported metal and 0-10 wt % of an additive, based on the total weight of the hydrogenation catalyst. Further preferably, the carrier is alumina and/or amorphous silica-alumina, the metal component is a Group VIB metal and/or a Group VIII metal, and the additive is at least one selected from fluorine, phosphorus, titanium and platinum; still more preferably, the Group VIB metal is Mo or/and W and the Group VIII metal is Co or/and Ni. Particularly preferably, the additive is present in an amount of from 0 to 10 wt %, the Group VIB metal is present in an amount of from 12 to 39 wt %, and the Group VIII metal is present in an amount of from 1 to 9 wt %, based on the total weight of the hydrogenation catalyst.

In some preferred embodiments, the fluidized catalytic conversion method of the present application further comprises the steps of:

7) recycling at least a part of the butylene separated in step 3) to the catalytic conversion reactor upstream of the position at which the olefin-rich feedstock is introduced to contact with the catalytic conversion catalyst for reaction.

In this embodiment, the high-temperature catalytic conversion catalyst is first contacted with the butylene recycled to the reactor, then contacted with the olefin-rich feedstock, and further contacted with the heavy feedstock. The difficulty of cracking the hydrocarbons is increased with the reduction of the number of carbon atoms thereof, and the energy required by cracking the butylene is relatively high, and therefore the high-temperature catalytic conversion catalyst in this embodiment is first contacted with the butylene, and then contacted with the feedstock rich in C5+ olefins, so that the butylene may be cracked at a higher temperature, the butylene conversion rate and the selectivity of the products ethylene and propylene may be improved, the generation of byproducts caused by co-feeding of the olefins can be reduced, and a highly efficient utilization of resources can be achieved.

Preferably, the reaction of step 7) is carried out under third catalytic conversion conditions including: a reaction temperature of 650-800° C., a reaction pressure of 0.05-1 MPa, a reaction time of 0.01-10 seconds, and a weight ratio of the catalytic conversion catalyst to the butylene of (20-200):1. Further preferably, the third catalytic conversion conditions include: a reaction temperature of 680-780° C., a reaction pressure of 0.1-0.8 MPa, a reaction time of 0.05-8 seconds, and a weight ratio of the catalytic conversion catalyst to the butylene of (30-180):1.

In a preferred embodiment, the fluidized catalytic conversion method of the present application further comprises the steps of:

2a) introducing an oxygen-containing organic compound into the second reaction zone of the fluidized catalytic conversion reactor to contact with the catalytic conversion catalyst for reaction therein.

Preferably, the reaction of step 2a) is carried out under fourth catalytic conversion conditions including: a reaction temperature of 300-550° C., a reaction pressure of 0.01-1 MPa, a reaction time of 0.01-100 seconds, and a weight ratio of the catalytic conversion catalyst to the oxygen-containing organic compound feedstock of (1-100):1. Further preferably, the fourth catalytic conversion conditions include: a reaction temperature of 400-530° C., a reaction pressure of 0.1-0.8 MPa, a reaction time of 0.1-80 seconds, and a weight ratio of the catalytic conversion catalyst to the oxygen-containing organic compound feedstock of (3-80):1.

In such embodiments of the present application, the oxygen-containing organic compound may be fed alone or in admixture with other feedstocks. For example, the oxygen-containing organic compound may be mixed with the heavy feedstock prior to being fed to the second reaction zone of the fluidized catalytic conversion reactor, or the oxygen-containing organic compound may be fed to the second reaction zone of the fluidized catalytic conversion reactor downstream of the position at which the heavy feedstock is introduced.

Particularly preferably, the oxygen-containing organic compound comprises at least one of methanol, ethanol, dimethyl ether, methyl ethyl ether and ethyl ether. For example, the oxygen-containing organic compound, such as methanol or dimethyl ether, may be derived from coal-based or natural gas-based syngas.

In a preferred embodiment, the fluidized catalytic conversion method of the present application further comprises the steps of:

8) regenerating the spent catalyst obtained by the separation in step 3) by coke burning to obtain a regenerated catalyst with the temperature of 650° C. or higher, and then recycling the regenerated catalyst to the upstream of the first reaction zone of the fluidized catalytic conversion reactor for use as the catalytic conversion catalyst.

In a preferred embodiment, the catalytic conversion catalyst used herein may comprise from 1 to 50 wt % of a molecular sieve, from 5 to 99 wt % of an inorganic oxide, and from 0 to 70 wt % of a clay, based on the total weight of the catalyst.

In a further preferred embodiment, in the catalytic conversion catalyst, the molecular sieve serves as an active component, and the molecular sieve may be selected from a macroporous molecular sieve, a mesoporous molecular sieve, and a microporous molecular sieve, or a combination thereof.

In some still further preferred embodiments, the mesoporous molecular sieve may be a ZSM molecular sieve, for example, the ZSM molecular sieve may be selected from ZSM-5, ZSM-11, ZSM-12, ZSM-23, ZSM-35, ZSM-48, or combinations thereof; the microporous molecular sieve may be a SAPO molecular sieve, which may be, for example, selected from SAPO-34, SAPO-11, SAPO-47, or a combination thereof, and/or an SSZ molecular sieve, which may be, for example, selected from SSZ-13, SSZ-39, SSZ-62, or a combination thereof; the macroporous molecular sieve may be selected from REY molecular sieves, REHY molecular sieves, ultrastable Y molecular sieves, high-silica Y molecular sieves, Beta molecular sieves and other molecular sieves of similar structure, or mixtures thereof.

In a particularly preferred embodiment, the molecular sieve comprises from 40 wt % to 100 wt %, preferably from 50 wt % to 100 wt %, of the mesoporous molecular sieve, and from 0 wt % to 30 wt %, preferably from 0 wt % to 25 wt %, of the microporous molecular sieve, and from 0 wt % to 30 wt %, preferably from 0 wt % to 25 wt %, of the macroporous molecular sieve, based on the total weight of the molecular sieve.

In a further preferred embodiment, in the catalytic conversion catalyst, the inorganic oxide serves as a binder, and preferably, the inorganic oxide may be selected from silicon dioxide ($SiO_2$) and/or aluminum oxide ($Al_2O_3$).

In a further preferred embodiment, in the catalytic conversion catalyst, the clay serves as a matrix, preferably the clay may be selected from kaolin and/or halloysite.

In a further preferred embodiment, the catalytic conversion catalyst used in the present application may further comprise a modifying element to further improve the catalytic performance of the catalytic conversion catalyst. For example, the catalytic conversion catalyst may comprise 0.1 to 3 wt % of the modifying element, based on the weight of the catalyst; the modifying element may be one or more selected from Group VIII metals, Group IVA metals, Group V metals and rare earth metals. In a further preferred embodiment, the modifying element may be one or more selected from phosphorus, iron, cobalt and nickel.

According to the present application, the heavy feedstock used in step 2) may be those commonly used in the art, and there is no particular limitation herein. In a preferred embodiment, the heavy feedstock may be selected from petroleum hydrocarbons and/or mineral oils; the petroleum hydrocarbon may be selected from vacuum gas oil, atmospheric gas oil, coker gas oil, deasphalted oil, vacuum residuum, atmospheric residuum, and heavy aromatic raffinate, or combinations thereof; the mineral oil may be selected from coal liquefaction oil, oil sand oil and shale oil, or a combination thereof.

According to the present application, the fluidized catalytic conversion reactor may comprise one reactor or a plurality of reactors connected in series and/or parallel.

In a preferred embodiment, the fluidized catalytic conversion reactor may be selected from a riser reactor, which may be an equal-diameter riser reactor or a diameter-transformed riser reactor, a fluidized bed reactor, which may be a constant-linear-velocity fluidized bed reactor or an equal-diameter fluidized bed reactor, an ascending transfer line, a descending transfer line, or a combination of two or more thereof, and the diameter-transformed riser reactor may be a riser reactor as described, for example, in Chinese patent CN1078094C.

In a further preferred embodiment, the fluidized catalytic conversion reactor is a riser reactor, more preferably a diameter-transformed riser reactor.

In a preferred embodiment, the olefin-rich stream separated in step 4) has an olefin content of 80 wt % or more, more preferably has a C5+ olefin content of 80 wt % or more. The higher the olefin content in the olefin-rich stream, the better the effect of refining and the better the utilization of resources.

According to the present application, the first separation in step 3) may be carried out using a separation apparatus commonly used in the art, such as a product fractionator.

In a preferred embodiment, the second separation of step 4) may be carried out using an olefin separator, resulting in an olefin-depleted stream and the olefin-rich stream. The second separation can increase the olefin content of the olefin-rich stream recycled to the fluidized catalytic conversion reactor, thereby further increasing the yield and selectivity of light olefins.

In some further preferred embodiments, the olefin-rich stream is further separated in the olefin separator to obtain a stream rich in large molecular olefin and a stream rich in small molecular olefin, the cut point between the two streams may be, for example, in a range of 140° C. to 200° C., wherein the stream rich in small molecular olefin is recycled to the first reaction zone of the fluidized catalytic conversion reactor in step 5) for further reaction; and the stream rich in large molecular olefin is recycled to the second reaction zone of the fluidized catalytic conversion reactor for further reaction.

Referring to FIG. 1, in a preferred embodiment, the fluidized catalytic conversion method of the present application is carried out as follows:

A pre-lifting medium is introduced from the bottom of a fluidized catalytic conversion reactor (a riser reactor) 102 via pipeline 101, a regenerated catalytic conversion catalyst from pipeline 117 moves upward along the fluidized catalytic conversion reactor 102 under the lifting action of the pre-lifting medium, and an olefin-rich feedstock (having an olefin content≥50%) is injected via pipeline 103 into the bottom of first reaction zone I of the reactor 102 along with atomized steam from pipeline 104, where it is contacted and reacted with the hot catalyst having a temperature 650° C. or higher and further moves upward.

A heavy feedstock oil is injected into the lower middle part of the fluidized catalytic conversion reactor 102 through pipeline 105 together with the atomized steam from pipeline 106 and mixed with the stream from the first reaction zone I in the second reaction zone II, and the heavy feedstock oil is contacted and reacted with the hot catalyst and moves upward.

The resulting reaction product and inactivated spent catalyst are passed to a cyclone separator 108 in the disengager through an outlet section 107 to conduct a separation of the spent catalyst and the reaction product, the reaction product is passed to a plenum chamber 109, and the fine catalyst powder is returned to the disengager through a dipleg. Spent catalyst in the disengager is passed to a stripping section 110 where it is contacted with stripping steam from pipeline 111. The product vapor stripped from the spent catalyst is passed to the plenum chamber 109 after passing through the cyclone separator. The stripped spent catalyst is passed to a regenerator 113 through a standpipe 112, and main air is introduced into the regenerator through pipeline 116 to burn out the coke on the spent catalyst so as to regenerate the inactivated spent catalyst. The flue gas is passed to a flue gas turbine via pipeline 115. The regenerated catalyst is passed to the reactor 102 via pipeline 117.

The reaction product (reaction product vapor) is passed to a subsequent product fractionator 120 through a reactor vapor line 119, the separated hydrogen, methane and ethane are withdrawn through pipeline 121, ethylene is withdrawn through pipeline 122, propylene is withdrawn through pipeline 123, butylene is withdrawn through pipeline 124, and optionally recycled to the bottom of the reactor 102 for further reaction, propane and butane are withdrawn through pipeline 125, the first catalytic cracking distillate oil is passed into an olefin separator 128 through pipeline 126, the separated olefin-depleted stream is withdrawn through pipeline 129, the olefin-rich stream is sent to the bottom of the first reaction zone I through pipeline 130 for further reaction, the second catalytic cracking distillate oil is passed into a hydrotreator 131 through pipeline 127, and a light component and a hydrogenated catalytic cracking distillate oil are obtained after a hydrotreatment, the light component is withdrawn through pipeline 118, the hydrogenated catalytic cracking distillate oil is withdrawn through pipeline 132, and optionally recycled to the second reaction zone II for further reaction.

Figure 2:
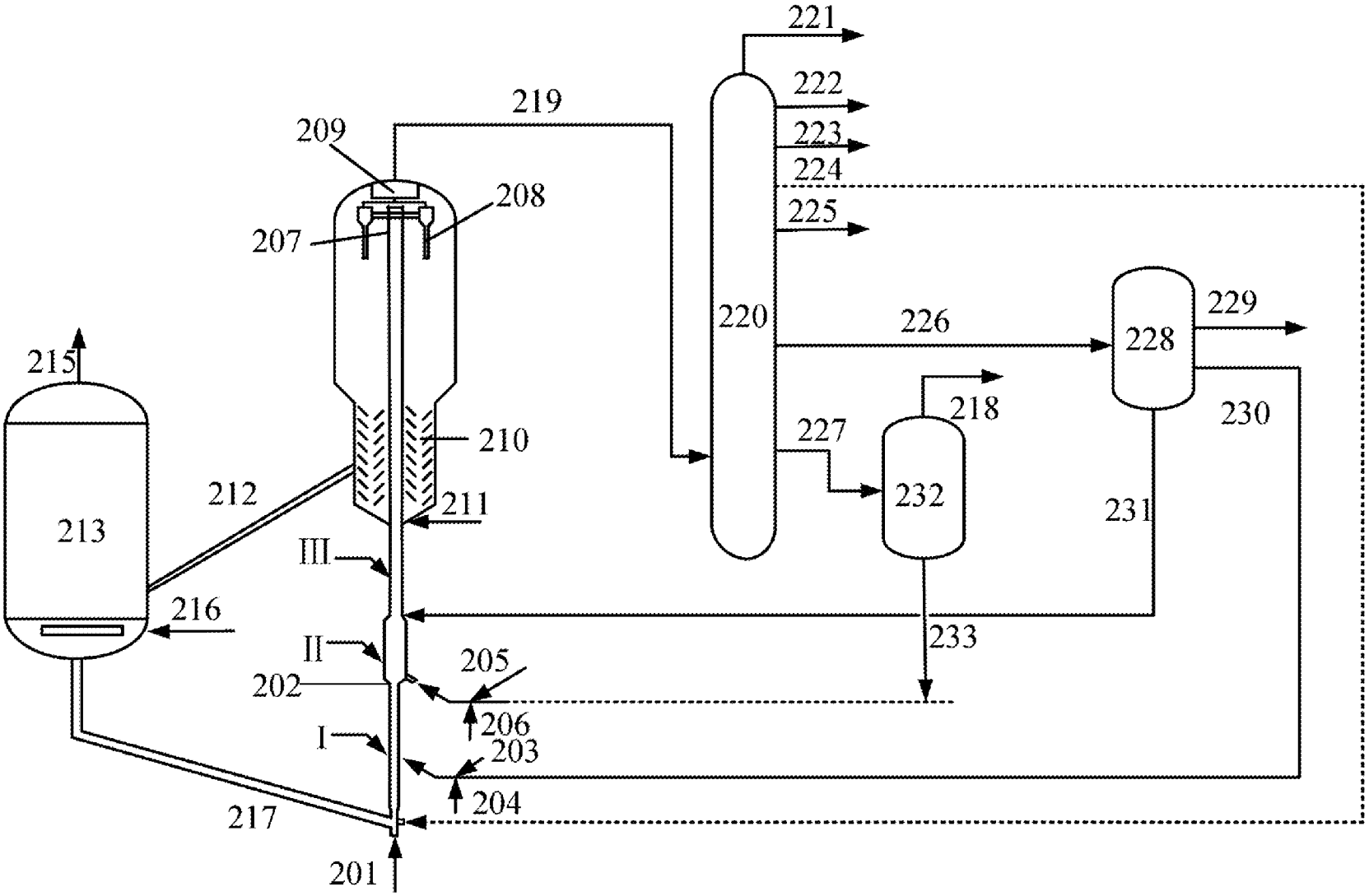
FIG. 2 shows a schematic flow diagram of another preferred embodiment of the fluidized catalytic conversion method of the present application.

Referring to FIG. 2, in another preferred embodiment, the fluidized catalytic conversion method of the present application is carried out as follows:

A pre-lifting medium is introduced from the bottom of a fluidized catalytic conversion reactor (a riser reactor) 202 through pipeline 201, a regenerated catalytic conversion catalyst from pipeline 217 moves upwards along the fluidized catalytic conversion reactor 202 under the lifting action of the pre-lifting medium, and an olefin-rich feedstock (having an olefin content of >50%) is injected into the bottom of the first reaction zone I of the reactor 202 through pipeline 203 together with atomized steam from pipeline 204, where it is contacted and reacted with the hot catalyst having a temperature of 650° C. or higher, and further moves upwards.

A heavy feedstock oil is injected into the lower middle part of the fluidized catalytic conversion reactor 202 via pipeline 205 together with atomized steam from pipeline 206 and is mixed with the stream from the first reaction zone I in the second reaction zone II, and the heavy feedstock oil is contacted and reacted with the hot catalyst and moves upward.

The resulting reaction product and inactivated spent catalyst are passed to a cyclone separator 208 in the disengager through an outlet section 207 to conduct a separation of the spent catalyst and the reaction product, the reaction product is passed to a plenum chamber 209, and the fine catalyst powder is returned to the disengager through a dipleg. Spent catalyst in the disengager is passed to a stripping section 210 where it is contacted with stripping steam from pipeline 211. The product vapor stripped from the spent catalyst is passed to the plenum chamber 209 after passing through the cyclone separator. The stripped spent catalyst is passed to a regenerator 213 through a standpipe 212, and main air is introduced into the regenerator through pipeline 216 to burn out the coke on the spent catalyst so as to regenerate the inactivated spent catalyst. The flue gas is passed to a flue gas turbine via pipeline 215. The regenerated catalyst is passed to the reactor 202 via pipeline 217.

The reaction product (reaction product vapor) is passed to a subsequent product fractionator 220 through a reactor vapor line 219, the separated hydrogen, methane and ethane are withdrawn through pipeline 221, ethylene is withdrawn through pipeline 222, propylene is withdrawn through pipeline 223, butylene is withdrawn through pipeline 224, and optionally recycled to the bottom of the reactor 202 for further reaction, propane and butane are withdrawn through pipeline 225, the first catalytic cracking distillate oil is passed into an olefin separator 228 through pipeline 226, the separated olefin-depleted stream is withdrawn through pipeline 229, the separated stream rich in small molecular olefin is passed into the first reaction zone I through pipeline 230 for further reaction, the separated stream rich in large molecular olefin is passed into the middle part of the reactor 202 through pipeline 231 for further reaction in a third reaction zone III at the downstream of the second reaction zone II, and the second catalytic cracking distillate oil is passed into a hydrotreator 232 through pipeline 227, and a light component and a hydrogenated catalytic cracking distillate oil are obtained after a hydrotreatment, wherein the light component is withdrawn through pipeline 218, and the hydrogenated catalytic cracking distillate oil is withdrawn through pipeline 233 and optionally recycled to the second reaction zone II for further reaction.

Figure 3:
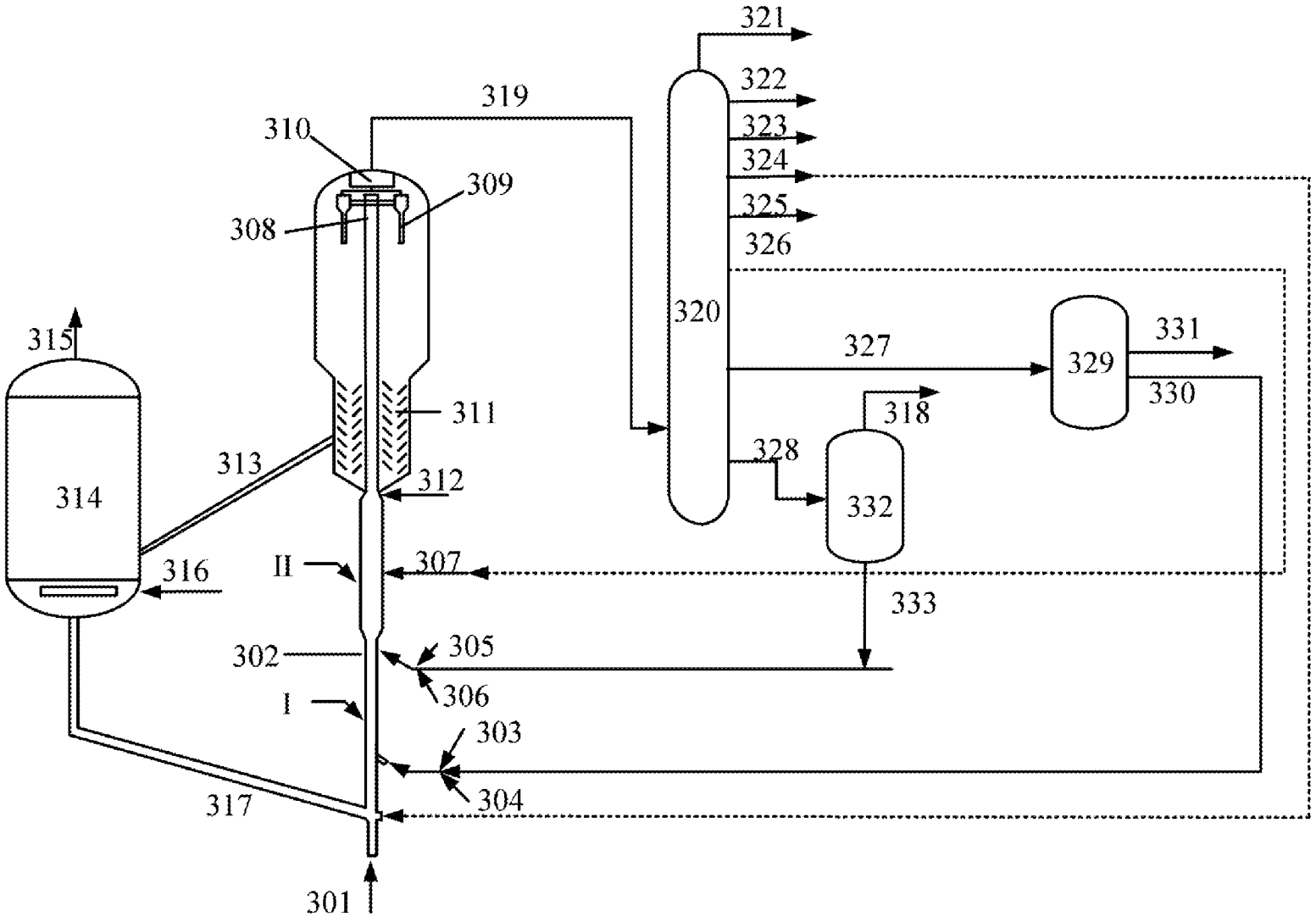
FIG. 3 shows a schematic flow diagram of yet another preferred embodiment of the fluidized catalytic conversion method of the present application.

Referring to FIG. 3, in yet another preferred embodiment, the fluidized catalytic conversion method of the present application is carried out as follows:

A pre-lifting medium is introduced from the bottom of the fluidized catalytic conversion reactor (a riser reactor) 302 through pipeline 301, a regenerated catalytic conversion catalyst from pipeline 317 moves upwards along the fluidized catalytic conversion reactor 302 under the lifting action of the pre-lifting medium, and an olefin-rich feedstock (having an olefin content of >50%) is injected into the bottom of the first reaction zone I of the reactor 302 through pipeline 303 together with atomized steam from pipeline 304, where it is contacted and reacted with the hot catalyst having a temperature of 650° C. or higher, and further moves upwards.

A heavy feedstock oil is injected into the lower middle part of the fluidized catalytic conversion reactor 302 via pipeline 305 together with atomized steam from pipeline 306 and mixed with the stream from the first reaction zone I in the second reaction zone II, and the heavy feedstock oil is contacted and reacted with the hot catalyst and moves upward.

An oxygen-containing organic compound (such as methanol) is injected into the second reaction zone II via pipeline 307 downstream of the position at which the heavy feedstock oil is injected and mixed with the stream therein, the oxygen-containing organic compound is contacted and reacted with the catalytic conversion catalyst and moves upward.

The resulting reaction product and inactivated spent catalyst are passed to a cyclone separator 309 in the disengager through an outlet section 308 to conduct a separation of the spent catalyst and the reaction product, the reaction product is passed to a plenum chamber 310, and the fine catalyst powder is returned to the disengager through a dipleg. Spent catalyst in the disengager is passed to a stripping section 311 where it is contacted with stripping steam from pipeline 312. The product vapor stripped from the spent catalyst is passed to the plenum 310 after passing through the cyclone separator. The stripped spent catalyst is passed to a regenerator 314 through a standpipe 313, and main air is introduced into the regenerator through pipeline 316 to burn out the coke on the spent catalyst so as to regenerate the inactivated spent catalyst. The flue gas is passed to a flue gas turbine via pipeline 315. The regenerated catalyst is passed to the reactor 302 via pipeline 317.

The reaction product (reaction product vapor) is passed to a subsequent product fractionator 320 through a reactor vapor line 319, the separated hydrogen, methane and ethane are withdrawn through pipeline 321, ethylene is withdrawn through pipeline 322, propylene is withdrawn through pipeline 323, butylene is withdrawn through pipeline 324 and optionally recycled to the bottom of the reactor 302 for further reaction, propane and butane are withdrawn through pipeline 325, and the separated unconverted oxygen-containing organic compound is withdrawn through pipeline 326 and optionally recycled to the second reaction zone II for further reaction; the first catalytic cracking distillate oil is introduced into an olefin separator 329 through pipeline 327, the separated olefin-depleted stream is withdrawn through pipeline 331, and the separated olefin-rich stream is introduced into the bottom of the first reaction zone I through pipeline 330 for further reaction; the second catalytic cracking distillate oil is passed into a hydrotreator 332 through a pipe 328, and a light component and a hydrogenated catalytic cracking distillate oil are obtained after a hydrotreatment, the light component is withdrawn through pipeline 318, and the hydrogenated catalytic cracking distillate oil is sent to the bottom of the second reaction zone II through pipeline 333 for further reaction.

In particularly preferred embodiments, the present application provides the following technical solutions:

A1, a catalytic conversion method for producing ethylene, propylene and butylene, comprising the steps of:

(1) contacting an olefin-rich feedstock having an olefin content of 50 wt % or higher with a catalytic conversion catalyst having a temperature of 650° C. or higher in a first reaction zone of a catalytic conversion reactor under first catalytic conversion conditions;

(2) contacting a heavy feedstock with the stream from the first reaction zone in a second reaction zone of the catalytic conversion reactor under second catalytic conversion conditions, to obtain reaction product vapor and a spent catalyst;

(3) carrying out a first separation on the reaction product vapor to separate ethylene, propylene, butylene, first catalytic cracking distillate oil and second catalytic cracking distillate oil; the initial boiling point of the first catalytic cracking distillate oil is in a range from greater than 20° C. to less than 140° C., the final boiling point of the second catalytic cracking distillate oil is in a range from greater than 250° C. to less than 550° C., and the cut point between the first catalytic cracking distillate oil and the second catalytic cracking distillate oil is between 140° C. and 250° C.;

carrying out a second separation on the first catalytic cracking distillate oil to separate an olefin-rich stream comprising 50 wt % or more of C5+ olefins; and (4) recycling the olefin-rich stream to the catalytic conversion reactor for further reaction.

A2, the method according to Item A1, wherein the method further comprises: contacting the second catalytic cracking distillate oil with a hydrogenation catalyst for reaction under hydrogenation conditions to obtain a hydrogenated second catalytic cracking distillate oil, and recycling the hydrogenated second catalytic cracking distillate oil to the catalytic conversion reactor for further reaction.

A3, the method according to Item A2, wherein the hydrogenated second catalytic cracking distillate oil is recycled to the second reaction zone of the catalytic conversion reactor for further reaction and the olefin-rich stream is recycled to the first reaction zone of the catalytic conversion reactor for further reaction; wherein the first reaction zone is upstream of the second reaction zone in the flow direction of the reaction stream.

A4, the method according to Item A3, wherein the separation system comprises a product fractionator and an olefin separator, and the method comprises:

passing the reaction product vapor into the product fractionator, and separating out ethylene, propylene, butylene, a first catalytic cracking distillate oil and a second catalytic cracking distillate oil;

passing the first catalytic cracking distillate oil to the olefin separator to separate out a first olefin-containing stream and a second olefin-containing stream; the cut point between the first olefin-containing stream and the second olefin-containing stream is between 140° C. and 200° C.;

recycling the first olefin-containing stream to the first reaction zone of the catalytic conversion reactor for further reaction, and recycling the second olefin-containing stream to the third reaction zone of the catalytic conversion reactor for further reaction;

wherein the third reaction zone is located downstream of the second reaction zone in the flow direction of the reaction stream.

A5, the method according to any one of Items A1 to A4, wherein the catalytic conversion reactor is a riser reactor, preferably a diameter-transformed riser reactor.

A6, the method according to Item A1, wherein the first catalytic conversion conditions include:

a reaction temperature of 650-750° C., preferably 630-750° C. and more preferably 630-720° C.;

a reaction pressure of 0.05 to 1 MPa, preferably 0.1 to 0.8 MPa, and more preferably 0.2 to 0.5 MPa;

a reaction time of 0.01-100 seconds, preferably 0.1-80 seconds, more preferably 0.2 to 70 seconds;

a weight ratio of the catalytic conversion catalyst to the olefin-rich feedstock of (1-100):1, preferably (3-150):1, more preferably (4-120):1;

the second catalytic conversion conditions include:

a reaction temperature of 400-650° C., preferably 450-600° C., and more preferably 480-580° C.;

a reaction pressure of 0.05 to 1 MPa, preferably 0.1 to 0.8 MPa, and more preferably 0.2 to 0.5 MPa;

a reaction time of 0.01-100 seconds, preferably 0.1-80 seconds, more preferably 0.2 to 70 seconds;

a weight ratio of the catalytic conversion catalyst to the heavy feedstock of (1-100):1, preferably (3-70):1, more preferably (4-30):1.

A7, the method according to Item A2, wherein the hydrogenation conditions include: a hydrogen partial pressure of 3.0-20.0 MPa, a reaction temperature of 300-450° C., a hydrogen-to-oil volume ratio of 300-2000, and a volume space velocity of 0.1-3.0 $h^{-1}$.

A8, the method according to Item A1, wherein the method further comprises: regenerating the spent catalyst by coke burning to obtain a regenerated catalyst; recycling the regenerated catalyst to the first reaction zone of the catalytic conversion reactor as the catalytic conversion catalyst.

A9, the method according to Item A1, wherein the olefin-rich feedstock has an olefin content of 80 wt % or more, preferably 90 wt % or more, more preferably a pure olefin feedstock; the olefins in the olefin-rich feedstock are selected from C5+ olefins;

the heavy oil is selected from petroleum hydrocarbon and/or mineral oil; the petroleum hydrocarbon is one or more selected from vacuum gas oil, atmospheric gas oil, coking gas oil, deasphalted oil, vacuum residuum, atmospheric residuum and heavy aromatic raffinate; the mineral oil is one or more selected from the group consisting of coal liquefication oil, oil sand oil and shale oil.

A10, the method according to Item A1 or A9, wherein the olefin-rich feedstock is derived from at least one of a C5+ fraction produced by an alkane dehydrogenation unit, a C5+ fraction produced by a catalytic cracking unit in an oil refinery, a C5+ fraction produced by a steam cracking unit in an ethylene plant, a C5+ olefin-rich byproduct fraction of MTO process, and a C5+ olefin-rich byproduct fraction of MTP process;

optionally, the alkane feedstock of the alkane dehydrogenation unit is derived from at least one of naphtha, aromatic raffinate and other light hydrocarbons.

A11, the method according to Item A1, wherein the catalytic conversion catalyst comprises, based on the total weight of the catalytic conversion catalyst, 1-50 wt % of a molecular sieve, 5-99 wt % of an inorganic oxide, and 0-70 wt % of a clay;

the molecular sieve comprises one or more of a macroporous molecular sieve, a mesoporous molecular sieve and a microporous molecular sieve;

the catalytic conversion catalyst further comprises 0.1-3 wt % of metal ion, based on the total weight of the catalytic conversion catalyst, wherein the metal ion is one or more selected from the group consisting of Group VIII metals, Group IVA metals and rare earth metals.

A12, the method according to Item A2, wherein the hydrogenation catalyst comprises 20 to 90 wt % of a carrier, 10 to 80 wt % of a supported metal, and 0 to 10 wt % of an additive, based on the total weight of the hydrogenation catalyst;

the carrier is alumina and/or amorphous silica-alumina, the additive is at least one selected from the group consisting of fluorine, phosphorus, titanium and platinum, and the supported metal is Group VIB metal and/or Group VIII metal;

preferably, the Group VIB metal is Mo or/and W, and the Group VIII metal is Co or/and Ni.

A13. the method according to Item A1, wherein the olefin-rich stream comprises 50 wt % or more of olefins, preferably 80 wt % or more of olefins.

B1, a catalytic conversion method for maximizing the production of ethylene with co-production of propylene, comprising the steps of:

S1, contacting a hydrocarbon oil feedstock having an olefin content of 50 wt % or higher with a catalytic conversion catalyst having a temperature of 650° C. or higher, and carrying out a first catalytic conversion reaction in a first reaction zone of a catalytic conversion reactor to obtain a first mixed stream;

S2, contacting a heavy feedstock oil with the first mixed stream in a second reaction zone of the catalytic conversion reactor, and carrying out a second catalytic conversion reaction to obtain a reaction stream and a spent catalyst; the second reaction zone is located downstream of the first reaction zone;

S3, carrying out a first separation on the reaction stream to obtain ethylene, propylene, butylene, a first catalytic cracking distillate oil and a second catalytic cracking distillate oil; the initial boiling point of the first catalytic cracking distillate oil is from more than 20° C. to less than 140° C., the final boiling point of the second catalytic cracking distillate oil is from more than 250° C. to less than 550° C., and the cut point between the first catalytic cracking distillate oil and the second catalytic cracking distillate oil is between 140° C. and 250° C.;

carrying out a second separation on the first catalytic cracking distillate oil to obtain an olefin-rich stream; and separately introducing the butylene and the olefin-rich stream into the catalytic conversion reactor for further reaction.

B2, the method according to Item B1, wherein, in step S3, the butylene introduced into the catalytic conversion reactor for further reaction is contacted with the catalytic conversion catalyst before the olefin-rich stream.

B3. the method according to Item B1, wherein the olefin in the olefin-rich stream is a C4+ olefin;

the olefin content of the olefin-rich stream is from 50 wt % to 100 wt %.

B4, the method according to Item B1, wherein the butylene and the olefin-rich stream are separately introduced into the first reaction zone of the catalytic conversion reactor for further reaction.

B5, the method according to Item B1, wherein the catalytic conversion reactor further comprises an A reaction zone and a B reaction zone; the A reaction zone is located between the first reaction zone and the second reaction zone; the B reaction zone is located downstream of the second reaction zone;

the second separation comprises: separating from the first catalytic cracking distillate oil a first olefin-rich stream and a second olefin-rich stream; the cut point between the first stream and the second stream is between 140-200° C.;

introducing the butylene into the first reaction zone for further reaction;

introducing the first stream into the A reaction zone for further reaction;

introducing the second stream into the B reaction zone for further reaction.

B6, the method according to Item B1, wherein the method further comprises: regenerating the spent catalyst by coke burning to obtain a regenerated catalyst; and preheating the regenerated catalyst and then recycling to the catalytic conversion reactor.

B7, the method according to Item B1, wherein the method further comprises:

carrying out a hydrotreatment on the second catalytic cracking distillate oil to obtain a hydrogenated product, and separating the hydrogenated catalytic cracking distillate oil from the hydrogenated product;

introducing the hydrogenated catalytic cracking distillate oil into the second reaction zone for further reaction.

B8, the method according to Item B7, wherein, the hydrotreating conditions include: a hydrogen partial pressure of 3.0-20.0 MPa, a reaction temperature of 300-450° C., a hydrogen-to-oil volume ratio of 300-2000, and a volume space velocity of 0.1-3.0

B9, the method according to Item B1, wherein the catalytic conversion reactor is one selected from a riser reactor, a constant-linear-velocity fluidized bed, an equal-diameter fluidized bed, an ascending transfer line, and a descending transfer line, or a combination of two of them connected in series;

the riser reactor is preferably a diameter-transformed riser reactor.

B10. the method according to Item B1, wherein the first catalytic conversion conditions include: a reaction temperature of 600-800° C., a reaction pressure of 0.05-1 MPa, a reaction time of 0.01-100 s, and a weight ratio of the catalytic conversion catalyst to the hydrocarbon oil feedstock of (1-200):1;

the second catalytic conversion conditions include: a reaction temperature of 400-650° C., a reaction pressure of 0.05-1 MPa, a reaction time of 0.01-100 seconds, and a weight ratio of the catalytic conversion catalyst to the heavy feedstock oil of (1-100):1;

preferably, the first catalytic conversion conditions include: a reaction temperature of 630-780° C., a reaction pressure of 0.1-0.8 MPa, a reaction time of 0.1-80 seconds, and a weight ratio of the catalytic conversion catalyst to the hydrocarbon oil feedstock of (3-180):1;

the second catalytic conversion conditions include: a reaction temperature of 450-600° C., a reaction pressure of 0.1-0.8 MPa, a reaction time of 0.1-80 seconds, and a weight ratio of the catalytic conversion catalyst to the heavy feedstock oil of (3-70):1.

B11, the method according to Item B1, wherein, the conditions for the further reaction of the butylene introduced into the catalytic reactor include: a reaction temperature of 650-800° C., a reaction pressure of 0.05-1 MPa, a reaction time of 0.01-10 seconds, and a weight ratio of the catalytic conversion catalyst to the butylene of (20-200):1;

preferably, the conditions include a reaction temperature of 680-780° C., a reaction pressure of 0.1-0.8 MPa, a reaction time of 0.05-8 seconds, and a weight ratio of the catalytic conversion catalyst to the butylene of (30-180):1.

B12, the method according to Item B1, wherein the hydrocarbon oil feedstock has an olefin content of 80 wt % or more; preferably 90 wt % or more; more preferably, the hydrocarbon oil feedstock is a pure olefin feedstock;

the heavy feedstock oil is petroleum hydrocarbon and/or mineral oil; the petroleum hydrocarbon is at least one selected from vacuum gas oil, atmospheric gas oil, coking gas oil, deasphalted oil, vacuum residuum, atmospheric residuum and heavy aromatic raffinate; the mineral oil is at least one selected from the group consisting of coal liquefaction oil, oil sand oil and shale oil.

B13, the method according to Item B1 or B12, wherein the olefins in the hydrocarbon oil feedstock are derived from a C4+ fraction produced by dehydrogenation of an alkane feedstock, a C4+ fraction produced by a catalytic cracking unit in an oil refinery, a C4+ fraction produced by a steam cracking unit in an ethylene plant, a C4+ olefin-rich byproduct fraction of an MTO process, and a C4+ olefin-rich byproduct fraction of an MTP process;

the alkane feedstock is at least one selected from the group consisting of naphtha, aromatic raffinate and light hydrocarbons.

B14, the method according to Item B1, wherein the catalytic conversion catalyst comprises, based on the weight of the catalytic conversion catalyst, 1-50 wt % of a molecular sieve, 5-99 wt % of an inorganic oxide, and 0-70 wt % of a clay;

the molecular sieve comprises one or more of a macroporous molecular sieve, a mesoporous molecular sieve and a microporous molecular sieve;

the catalytic conversion catalyst further comprises 0.1-3 wt % of a modifying element, based on the weight of the catalytic conversion catalyst; the modifying element is one or more selected from the group consisting of Group VIII metals, Group IVA metals and rare earth metals.

C1, a catalytic conversion method for producing light olefins, which comprises the following steps:

(1) contacting an olefin-rich feedstock with a catalytic conversion catalyst having a temperature of 650° C. or higher in a first reaction zone of a catalytic conversion reactor and conducting a first catalytic conversion reaction under first catalytic conversion conditions, to obtain a first mixed stream; the olefin-rich feedstock has an olefin content of 50 wt % or higher;

(2) contacting a heavy feedstock and an oxygen-containing organic compound feedstock with the first mixed stream from the first reaction zone in a second reaction zone of the catalytic conversion reactor and conducting a second catalytic conversion reaction under second catalytic conversion conditions, to obtain reaction product vapor and a spent catalyst;

(3) carrying out a first separation on the reaction product vapor to separate ethylene, propylene, butylene, the oxygen-containing organic compound, a first catalytic cracking distillate oil and a second catalytic cracking distillate oil; the initial boiling point of the first catalytic cracking distillate oil is from more than 20° C. to less than 140° C., the final boiling point of the second catalytic cracking distillate oil is from more than 250° C. to less than 550° C., and the cut point between the first catalytic cracking distillate oil and the second catalytic cracking distillate oil is between 140° C. and 250° C.;

carrying out a second separation on the first catalytic cracking distillate oil to separate an olefin-rich stream;

(4) recycling the olefin-rich stream to the catalytic conversion reactor for further reaction.

C2, the method according to Item C1, wherein the method comprises: passing the reaction product vapor to a product fractionator for first separation, and separating out ethylene, propylene, butylene, the oxygen-containing organic compound, the first catalytic cracking distillate oil and the second catalytic cracking distillate oil;

passing the first catalytic cracking distillate oil into an olefin separator for second separation, and separating out the olefin-rich stream;

recycling the olefin-rich stream to the first reaction zone of the catalytic conversion reactor for further reaction.

C3, the method according to Item C1, wherein the method comprises: passing the reaction product vapor to a product fractionator for first separation, and separating out ethylene, propylene, butylene, the oxygen-containing organic compound, the first catalytic cracking distillate oil and the second catalytic cracking distillate oil;

passing the first catalytic cracking distillate oil into an olefin separator for third separation, and separating out a stream of large molecular olefins and a stream of small molecular olefins;

recycling the stream of small molecule olefins as the olefin-rich stream to the first reaction zone of the catalytic conversion reactor for further reaction; recycling the stream of large molecular olefins to the second reaction zone of the catalytic conversion reactor for further reaction.

C4, the method according to any of Items C1 to C3, wherein the method further comprises: recycling the separated butylene to the first reaction zone of the catalytic conversion reactor for further reaction; preferably, the butylene recycled to the catalytic conversion reactor for further reaction are contacted with the catalytic conversion catalyst prior to the olefin-rich stream.

C5, the method according to Item C4, wherein the conditions for the further reaction of the butylene recycled to the catalytic reactor include: a reaction temperature of 650-800° C., a reaction pressure of 0.05-1 MPa, a reaction time of 0.01-10 seconds, and a weight ratio of the catalytic conversion catalyst to the recycled butylene of (20-200):1;

preferably, the conditions include a reaction temperature of 680-780° C., a reaction pressure of 0.1-0.8 MPa, a reaction time of 0.05-8 seconds, and a weight ratio of the catalytic conversion catalyst to the recycled butylene of (30-180):1.

C6, the method according to Item C 1, wherein the first catalytic conversion conditions include:

a reaction temperature of 600-800° C., preferably 630-780° C.;

a reaction pressure of 0.05-1 MPa, preferably 0.1-0.8 MPa;

a reaction time of 0.01-100 seconds, preferably 0.1-80 seconds;

a weight ratio of the catalytic conversion catalyst to the olefin-rich feedstock of (1-200):1, preferably (3-180):1.

C7, the method according to Item C1 or C6, wherein the second catalytic conversion conditions include:

a reaction temperature of 300-650° C., preferably 400-600° C.;

a reaction pressure of 0.01-1 MPa, preferably 0.05-1 MPa;

a reaction time of 0.01-100 seconds, preferably 0.1-80 seconds;

a weight ratio of the catalytic conversion catalyst to the heavy feedstock of (1-100):1, preferably (3-70):1; a weight ratio of the catalytic conversion catalyst to the oxygen-containing organic compound feedstock of (1-100):1, preferably (3-50):1;

the reaction temperature of the first catalytic conversion reaction is 30-380° C. higher than the reaction temperature of the second catalytic conversion reaction.

C8, the method according to Item C1 or C6, wherein the second reaction zone is divided into an upstream part and a downstream part along the flow direction of the reaction stream, bounded by the feeding position of the oxygen-containing organic compound feedstock, the downstream part of the second reaction zone is located downstream of the feeding position of the oxygen-containing organic compound feedstock; the method further comprises the following steps:

contacting the first mixed stream from the first reaction zone with the heavy feedstock in the upstream part of the second reaction zone and conducting a catalytic conversion reaction to obtain a second mixed stream; and then contacting the second mixed stream with the oxygen-containing organic compound feedstock in the downstream part of the second reaction zone and conducting a catalytic conversion reaction to obtain the reaction product vapor and the spent catalyst.

C9, the method according to Item C8, wherein the catalytic conversion conditions of the heavy feedstock and the first mixed stream in the upstream part of the second reaction zone include:

a reaction temperature of 400-650° C., preferably 450-600° C.;

a reaction pressure of 0.05-1 MPa, preferably 0.1-0.8 MPa;

a reaction time of 0.01-100 seconds, preferably 0.1-80 seconds;

a weight ratio of the catalytic conversion catalyst to the heavy feedstock of (1-100):1, preferably (3-70):1;

the catalytic conversion conditions of the oxygen-containing organic compound feedstock and the second mixed stream in the downstream part of the second reaction zone include:

a reaction temperature of 300-550° C., preferably 400-530° C.;

a reaction pressure of 0.01-1 MPa, preferably 0.05-1 MPa;

a reaction time of 0.01-100 seconds, preferably 0.1-80 seconds;

a reaction temperature in the upstream part of the second reaction zone being 0-200° C. higher, preferably 10-190° C. higher, than the reaction temperature in the downstream part of the second reaction zone;

a weight ratio of the catalytic conversion catalyst to the oxygen-containing organic compound feedstock of (1-100):1, preferably (3-50):1.

C10, the method according to Item C1, wherein the method further comprises: recycling the separated oxygen-containing organic compound to the second reaction zone of the catalytic conversion reactor for further reaction.

C11, the method according to any of Items C1 to C10, wherein the catalytic conversion reactor is a riser reactor, preferably a diameter-transformed riser reactor.

C12, the method according to Item C1, wherein the method further comprises: regenerating the spent catalyst by coke burning to obtain a regenerated catalyst; recycling the regenerated catalyst to the first reaction zone of the catalytic conversion reactor as the catalytic conversion catalyst.

C13, the method according to Item C1, wherein the olefin-rich feedstock has an olefin content of 80 wt % or more, preferably 90 wt % or more, more preferably is a pure olefin feedstock;

the heavy oil is selected from petroleum hydrocarbon and/or mineral oil; the petroleum hydrocarbon is one or more selected from vacuum gas oil, atmospheric gas oil, coking gas oil, deasphalted oil, vacuum residuum, atmospheric residuum and heavy aromatic raffinate; the mineral oil is one or more selected from the group consisting of coal liquefication oil, oil sand oil and shale oil;

optionally, the oxygen-containing organic compound feedstock comprises at least one of methanol, ethanol, dimethyl ether, methyl ethyl ether, and diethyl ether.

C14, the method according to Item C1 or C13, wherein the olefin-rich feedstock is derived from at least one of a C5+ fraction produced by an alkane dehydrogenation unit, a C5+ fraction produced by a catalytic cracking unit in an oil refinery, a C5+ fraction produced by a steam cracking unit in an ethylene plant, a C5+ olefin-rich byproduct fraction of MTO process, and a C5+ olefin-rich byproduct fraction of MTP process;

optionally, the alkane feedstock of the alkane dehydrogenation unit is derived from at least one of naphtha, aromatic raffinate and other light hydrocarbons.

C15, the method according to Item C1, wherein the catalytic conversion catalyst comprises 1-50 wt % of a molecular sieve, 5-99 wt % of an inorganic oxide, and 0-70 wt % of a clay, based on the total weight of the catalytic conversion catalyst;

the molecular sieve comprises one or more of a macroporous molecular sieve, a mesoporous molecular sieve and a microporous molecular sieve;

the catalytic conversion catalyst further comprises 0.1-3 wt % of metal ion, based on the total weight of the catalytic conversion catalyst, wherein the metal ion is one or more selected from the group consisting of Group VIII metals, Group IVA metals and rare earth metals.

C16, the method according to Item C1, wherein the second catalytic cracking distillate oil is contacted with a hydrogenation catalyst for reaction under hydrogenation conditions, to obtain a hydrogenated second catalytic cracking distillate oil, and the hydrogenated second catalytic cracking distillate oil is recycled to the catalytic conversion reactor for further reaction;

wherein the hydrogenation conditions include: a hydrogen partial pressure of 3.0-20.0 MPa, a reaction temperature of 300-450° C., a hydrogen-to-oil volume ratio of 300-2000, a volume space velocity of 0.1-3.0 $h^{-1}$, and the hydrogenation catalyst comprises 20-90 wt % of a carrier, 10-80 wt % of a supported metal and 0-10 wt % of an additive, based on the total weight of the hydrogenation catalyst;

wherein the carrier is alumina and/or amorphous silica-alumina, the additive is at least one selected from the group consisting of fluorine, phosphorus, titanium and platinum, and the supported metal is Group VIB metal and/or Group VIII metal;

preferably, the Group VIB metal is Mo or/and W, and the Group VIII metal is Co or/and Ni.

C17, the method according to Item C 1, wherein the olefins in the olefin-rich stream are C5+ olefins;

the olefin-rich stream has a C5+ olefin content of 50 wt % or more, preferably 80 wt % or more.

EXAMPLES

The present application will be described in further detail below with reference to examples. The feedstocks used in the examples are all commercially available.

Feedstock and Catalyst

The Feedstocks I and II used in the following examples are heavy feedstock oils, that is Heavy oil I and Heavy oil II, respectively, and their properties are shown in Tables 1-1 and 1-2 below.

TABLE 1-1

| Properties of Heavy oil I | |
|---|---|
| Properties | Heavy oil I |
| Density (20° C.)/(kg/m$^3$) | 859.7 |
| Conradson carbon residue, wt % | 0.07 |
| C, wt % | 85.63 |
| H, wt % | 13.45 |
| S, wt % | 0.077 |
| N, wt % | 0.058 |
| Fe, μg/g | 2.3 |
| Na, μg/g | 0.6 |
| Ni, μg/g | 4.9 |
| V, μg/g | 0.4 |

TABLE 1-1-continued

| Properties of Heavy oil I | |
|---|---|
| Properties | Heavy oil I |
| Group composition, wt % | |
| Saturates | 58.1 |
| Aromatics | 26.3 |
| Resins | 15.3 |
| Asphaltenes | 0.3 |

TABLE 1-2

| Properties of Heavy oil II | |
|---|---|
| Properties | Heavy oil II |
| Density (20° C.)/(kg/m$^3$) | 901.5 |
| Conradson carbon residue, wt % | 4.9 |
| H, wt % | 12.86 |
| S, wt % | 0.16 |
| N, wt % | 0.26 |
| Ni, μg/g | 6.2 |
| Hydrocarbon composition, wt % | |
| Saturates | 54.8 |
| Aromatics | 28.4 |
| Resins | 16.0 |
| Asphaltenes | 0.8 |

The preparation or source of the various catalysts used in the following examples and comparative examples is as follows:

1) Catalyst i: it was prepared as follows:

969 g of halloysite (product of China Kaolin Clay Co., Ltd., with solid content of 73%) was slurried with 4300 g of decationized water, 781 g of pseudo-boehmite (product of CHALCO Shandong Co., Ltd, with solid content of 64%) and 144 ml of hydrochloric acid (with concentration of 30% and specific gravity of 1.56) were added and stirred evenly, the mixture was kept stand and aged for 1 hour at 60° C., while maintaining the pH value at 2-4, the mixture was cooled to room temperature, and 5000 g of a prepared slurry was added, which comprised 1600 g of a mesoporous ZSM-5 molecular sieve and a macroporous Y molecular sieve (produced by Qilu Branch of Sinopec Catalyst Co,. Ltd.), and the weight ratio of the mesoporous ZSM-5 molecular sieve to the macroporous Y molecular sieve was 9:1. The mixture was stirred uniformly, spray dried, and washed to remove free Na+ to obtain a catalyst. The catalyst obtained was aged at 800° C. with 100% steam, the aged catalyst was referred to as Catalyst i, the properties of which are shown in Table 2.

2) Catalyst ii: an industrial product available from Qilu Branch of Sinopec Catalyst Co., Ltd. under a trade name of CEP-1, the properties of which are shown in Table 2.

3) Catalyst iii: an industrial product available from Qilu Branch of Sinopec Catalyst Co., Ltd. under a trade name of CHP-1, the properties of which are shown in Table 2.

4) Catalyst iv: it was prepared as follows:

Ammonium metatungstate ($(NH_4)_2W_4O_{13}\cdot 18H_2O$, chemically pure) and nickel nitrate ($Ni(NO_3)_2\cdot 18H_2O$, chemically pure) were weighed and mixed with water to obtain a 200 ml solution. The solution was added to 50 g of alumina carrier, impregnated for 3 hours at room temperature, the impregnation solution was treated with ultrasonic waves for 30 minutes during the impregnation, cooled, filtered, and dried in a microwave oven for about 15 minutes. The catalyst comprises the following components: 30.0 wt % of $WO_3$, 3.1 wt % of NiO, and the balance of alumina, and is designated as Catalyst iv.

5) Catalyst v: it was prepared as follows:

1000 g of pseudo-boehmite produced by ChangLing Branch of Sinopec Catalyst Co., Ltd. was weighed, 1000 ml of aqueous solution comprising 10 ml of nitric acid (chemically pure) was added thereto, shaped by extrusion molding on a double-screw extruder, dried at 120° C. for 4 hours, and calcined at 800° C. for 4 hours to obtain a catalyst carrier. The resultant was impregnated with 900 ml of aqueous solution comprising 120 g of ammonium fluoride for 2 hours, dried for 3 hours at 120° C., and calcined for 3 hours at 600° C.; after cooling to room temperature, the resultant was impregnated with 950 ml of an aqueous solution comprising 133 g of ammonium metamolybdate for 3 hours, dried at 120° C. for 3 hours, and calcined at 600° C. for 3 hours; and after cooling to room temperature, the resulting was impregnated with 900 ml of an aqueous solution comprising 180 g of nickel nitrate and 320 g of ammonium metatungstate for 4 hours, and the fluorinated alumina carrier was impregnated with a mixed aqueous solution comprising 0.1 wt % of ammonium metamolybdate (chemically pure) and 0.1 wt % of nickel nitrate (chemically pure) relative to the catalyst carrier for 4 hours, dried at 120° C. for 3 hours, and calcined at 600° C. for 4 hours, to obtain a catalyst v.

TABLE 2

Properties of Catalysts i-iii

| Catalyst No. | Catalyst i | Catalyst ii | Catalyst iii |
|---|---|---|---|
| Chemical composition/wt % | | | |
| $Al_2O_3$ | 49.2 | 26.5 | 46.3 |
| $Na_2O$ | 0.07 | 0.19 | 0.04 |
| Physical Properties | | | |
| Specific surface area/($m^2 \times g^{-1}$) | / | 132 | 153 |
| Bulk density/($g \times cm^{-3}$) | 0.79 | 0.45 | 0.86 |
| Abrasion index/($\% \times h^{-1}$) | 1.1 | 4.2 | 1.0 |
| Size distribution/wt % | | | |
| 0-40 mm | 14.2 | 7.3 | 17.9 |
| 40-80 mm | 53.8 | 43.7 | 41.4 |
| >80 mm | 32.0 | 49.0 | 40.7 |

Example 1

An experiment was carried out on a pilot plant of a riser reactor according to the scheme shown in FIG. 1 as follows:

1-pentene feedstock was contacted with the high-temperature catalytic conversion Catalyst i having a temperature of 750° C. at the bottom of a first reaction zone of a riser reactor under conditions including a reaction temperature of 700° C., a reaction pressure of 0.1 MPa, a reaction time of 5 seconds, and a weight ratio of the catalyst to the feedstock of 45:1.

Heavy oil I was mixed with the stream from the first reaction zone at the bottom of a second reaction zone of the riser reactor, and contacted with the Heavy oil I and the catalytic conversion Catalyst I for reaction under conditions including a reaction temperature of 530° C., a reaction pressure of 0.1 MPa, a reaction time of 6 seconds, and a weight ratio of the catalyst to the Heavy oil I of 5:1.

The resulting reaction product was separated from the spent catalyst, the spent catalyst was regenerated by coke burning in a regenerator, and the regenerated catalyst was recycled to the bottom of the riser reactor; the reaction product was separated to obtain ethylene, propylene, butylene, an C5+ olefin-containing stream having an olefin content of 80 wt %, a second catalytic cracking distillate oil having a boiling point of more than 250° C., and the like.

The second catalytic cracking distillate oil was reacted with the hydrogenation Catalyst iv under conditions including a temperature of 350° C., a hydrogen partial pressure of 18 MPa, a volume space velocity of 15 $h^{-1}$ and a hydrogen-oil volume ratio of 1500 to obtain the hydrogenated catalytic cracking distillate oil.

The separated olefin-rich stream was recycled to the bottom of the first reaction zone for further cracking; the hydrogenated catalytic cracking distillate oil was mixed with the heavy feedstock oil and then recycled to the second reaction zone for further reaction. The reaction conditions and product distribution are listed in Table 3.

Comparative Example 1

An experiment was carried out on a pilot plant of a riser reactor as described in Example 1, expect that no 1-pentene feedstock was introduced in the first reaction zone, and no olefin-rich stream was separated, as follows:

The catalytic conversion Catalyst i having a temperature of 600° C. was introduced into the bottom of the riser reactor, and Heavy oil I was contacted and reacted with the catalytic conversion Catalyst i at the bottom of the second reaction zone, under conditions including a reaction temperature of 530° C., a reaction pressure of 0.1 MPa, a reaction time of 6 seconds, and a weight ratio of the catalyst to the Heavy oil I of 5:1.

The resulting reaction product was separated from the spent catalyst, the spent catalyst was regenerated by coke burning in a regenerator, and the regenerated catalyst was recycled to the bottom of the riser reactor; the reaction product was separated to obtain ethylene, propylene, butylene and a second catalytic cracking distillate oil with a boiling point of more than 250° C.

The second catalytic cracking distillate oil was reacted with the hydrogenation Catalyst iv under conditions including a temperature of 350° C., a hydrogen partial pressure of 18 MPa, a volume space velocity of 15 $h^{-1}$ and a hydrogen-to-oil volume ratio of 1500 to obtain a hydrogenated catalytic cracking distillate oil. The resulting hydrogenated catalytic cracking distillate oil was mixed with the heavy feedstock oil and then recycled to the second reaction zone for reaction. The reaction conditions and product distribution are listed in Table 3.

Example 2

An experiment was carried out on a pilot plant of a riser reactor, as described in Example 1, except that no olefin-rich feedstock from external source was introduced into the first reaction zone, as follows:

Catalytic conversion Catalyst i having a temperature of 750° C. was introduced into the bottom of the riser reactor, and Heavy oil I was contacted and reacted with the catalytic conversion Catalyst i at the bottom of the second reaction zone, under conditions including a reaction temperature of 530° C., a reaction pressure of 0.1 MPa, a reaction time of 6 seconds, and a weight ratio of the catalyst to Heavy oil I of 5:1.

The resulting reaction product was separated from the spent catalyst, the spent catalyst was regenerated by coke burning in a regenerator, and the regenerated catalyst was recycled to the bottom of the riser reactor; the reaction product was separated to obtain ethylene, propylene, butylene, a C5+ olefin-containing stream having an olefin content of 80 wt %, a second catalytic cracking distillate oil having a boiling point of more than 250° C., and the like. The second catalytic cracking distillate oil was reacted with the hydrogenation Catalyst iv under conditions including a temperature of 350° C., a hydrogen partial pressure of 18 MPa, a volume space velocity of 15 $h^{-1}$ and a hydrogen-to-oil volume ratio of 1500 to obtain a hydrogenated catalytic cracking distillate oil. The resulting olefin-rich stream was recycled to the bottom of the first reaction zone for further cracking, under conditions including a reaction temperature of 700° C., a reaction pressure of 0.1 MPa, and a reaction time of 5 seconds; the hydrogenated catalytic cracking distillate oil was mixed with the heavy feedstock oil and then recycled to the second reaction zone for reaction. The reaction conditions and product distribution are listed in Table 3.

Comparative Example 2

An experiment was carried out on a pilot plant of a riser reactor, Heavy oil I was contacted with catalytic conversion Catalyst ii at 680° C. at the bottom of the riser reactor for reaction under conditions including a reaction temperature of 610° C., a reaction pressure of 0.1 MPa, a reaction time of 6 seconds, and a weight ratio of the catalyst to the feedstock of 16.9:1. The resulting reaction product was separated from the spent catalyst, the spent catalyst was regenerated by coke burning in a regenerator, and the regenerated catalyst was recycled to the bottom of the riser reactor; the reaction product was not subjected to hydrotreatment or further reaction after separation. The reaction conditions and product distribution are listed in Table 3.

Example 3

An experiment was carried out as described in Example 2, except that Heavy oil II was used instead of Heavy oil I, and the second catalytic cracking distillate oil having a boiling point of greater than 250° C. was contacted with hydrodesulfurization Catalyst v in a hydrodesulfurization reactor, and reacted under conditions including a reaction pressure of 6.0 MPa, a reaction temperature of 350° C., a hydrogen-to-oil volume ratio of 350, and a volume space velocity of 2.0 $h^{-1}$, to obtain a low-sulfur hydrogenated catalytic cracking distillate oil which was withdrawn as a light oil component without recycling to the riser reactor for further reaction. The reaction conditions and product distribution are listed in Table 3.

Comparative Example 3

An experiment was carried out on a pilot plant of a riser reactor, Heavy oil II was contacted with catalytic conversion Catalyst iii having a temperature of 680° C. at the bottom of the riser reactor for reaction under conditions including a reaction temperature of 530° C., a reaction pressure of 0.1 MPa, a reaction time of 6 seconds, and a weight ratio of the catalyst to the feedstock of 5:1.

The resulting reaction product was separated from the spent catalyst, the spent catalyst was regenerated by coke burning in a regenerator, and the regenerated catalyst was recycled to the bottom of the riser reactor; the reaction product obtained after separation was not recycled to the riser reactor for further reaction, and the hydrotreating of the second catalytic cracking distillate was the same as that in Example 3. The reaction conditions and product distribution are listed in Table 3.

Example 4

An experiment was carried out as described in Example 1, except that the reaction conditions shown in Table 3 were employed.

Example 5

An experiment was carried out as described in Example 1, except that the reaction conditions shown in Table 3 were employed.

Example 6

An experiment was carried out as described in Example 1, except that the separated butylene was recycled to the bottom of the riser reactor for cracking under conditions including a reaction temperature of 710° C., a catalyst to butylene weight ratio of 100:1, a reaction time of 0.2 s, the reaction conditions and product distribution are shown in Table 3.

TABLE 3

Reaction conditions and product distribution of Examples 1-6 and Comparative Examples 1-3

| | Ex. 1 | Comp. Ex. 1 | Ex. 2 | Comp. Ex. 2 | Ex. 3 | Comp. Ex. 3 | Ex. 4 | Ex. 5 | Ex. 6 |
|---|---|---|---|---|---|---|---|---|---|
| First reaction zone/riser reactor | | | | | | | | | |
| Catalytic conversion catalyst | Catalyst i | Catalyst i | Catalyst i | Catalyst ii | Catalyst i | Catalyst iii | Catalyst i | Catalyst i | Catalyst i |
| Temperature of regenerated catalyst, ° C. | 750 | 600 | 750 | 680 | 750 | 680 | 650 | 800 | 750 |
| Feedstock | 1-pentene | — | Recycled olefin-rich stream | Heavy oil I | Recycled olefin-rich stream | Heavy oil II | 1-pentene | 1-pentene | 1-pentene |
| Reaction temperature, ° C. | 700 | | 700 | 610 | 700 | 530 | 600 | 750 | 700 |

TABLE 3-continued

| Reaction conditions and product distribution of Examples 1-6 and Comparative Examples 1-3 | | | | | | | | | |
|---|---|---|---|---|---|---|---|---|---|
| | Ex. 1 | Comp. Ex. 1 | Ex. 2 | Comp. Ex. 2 | Ex. 3 | Comp. Ex. 3 | Ex. 4 | Ex. 5 | Ex. 6 |
| Catalyst-to-oil ratio | 45 | | — | 16.9 | — | 5 | 45 | 45 | 45 |
| Reaction time, seconds | 5 | | 5 | 6 | 5 | 6 | 5 | 5 | 5 |
| Second reaction zone | | | | | | | | | |
| Feedstock | Heavy oil I | Heavy oil I | Heavy oil I | — | Heavy oil II | — | Heavy oil I | Heavy oil I | Heavy oil I |
| Reaction temperature, ° C. | 530 | 530 | 530 | | 530 | | 530 | 530 | 530 |
| Catalyst-to-oil ratio | 5 | 5 | 5 | | 5 | | 5 | 5 | 5 |
| Reaction time, seconds | 6 | 6 | 6 | | 6 | | 6 | 6 | 6 |
| Hydrogenation unit | | | | | | | | | |
| Catalyst | Catalyst iv | Catalyst iv | Catalyst iv | — | Catalyst v | Catalyst v | Catalyst iv | Catalyst iv | Catalyst iv |
| Temperature, ° C. | 350 | 350 | 350 | | 350 | 350 | 350 | 350 | 350 |
| Hydrogen-to-oil volume ratio | 1500 | 1500 | 1500 | | 350 | 350 | 1500 | 1500 | 1500 |
| Yield, wt % | | | | | | | | | |
| Hydrogen + methane + ethane | 5.24 | 3.08 | 4.77 | 12.58 | 5.41 | 1.56 | 4.66 | 6.91 | 5.41 |
| Ethylene | 11.43 | 1.42 | 9.92 | 13.71 | 10.64 | 1.44 | 9.22 | 14.52 | 29.79 |
| Propylene | 26.92 | 16.71 | 26.95 | 21.45 | 28.34 | 10.11 | 21.14 | 25.10 | 33.02 |
| Butylene | 24.01 | 15.57 | 22.50 | 12.24 | 22.86 | 8.78 | 22.07 | 18.06 | — |
| Propane + butane | 4.43 | 4.05 | 4.31 | 3.76 | 4.89 | 5.91 | 6.01 | 3.49 | 4.51 |
| Benzene | 4.72 | 0.93 | 3.95 | 3.61 | 4.80 | 4.84 | 5.71 | 5.66 | 5.20 |
| Toluene | 2.03 | 0.44 | 1.62 | 3.15 | 2.66 | 3.17 | 3.00 | 3.14 | 2.88 |
| Xylene | 1.00 | 0.03 | 1.01 | 2.92 | 1.48 | 1.03 | 1.24 | 2.04 | 1.94 |
| Light oil | 16.84 | 55.26 | 21.34 | 16.91 | 14.80 | 58.17 | 24.49 | 16.79 | 13.63 |
| Coke | 3.38 | 2.51 | 3.63 | 9.67 | 4.12 | 4.99 | 2.46 | 4.29 | 3.62 |
| Total | 100.00 | 100.00 | 100.00 | 100.00 | 100.00 | 100.00 | 100.00 | 100.00 | 100.00 |
| Ethylene + propylene + butylene | 62.36 | 33.70 | 59.37 | 47.40 | 61.84 | 20.33 | 52.43 | 57.68 | 62.81 |

As can be seen from the results shown in Table 3, compared with Comparative Examples 1-3, the fluidized catalytic conversion method of the present application shows higher yields of ethylene, propylene and butylene, and the total yield of three olefins can reach 50% or higher; in Examples 1-3, when the olefin cracking was carried out at 700° C., the total yield of the ethylene, the propylene and the butylene in the product can reach 60% or higher; and as the olefin content of the feedstock increases the yield is further improved, for example when 1-pentene having an olefin content of 100% was used as the olefin-rich feedstock (see Example 1), the yield of ethylene in the product was 11.43%, the yield of propylene was 26.92%, the yield of butylene was 24.01%, and the total yield of the three was as high as 62.36%. As the catalytic cracking temperature increases, the ethylene yield could be further increased as shown in Example 5; and by recycling the butylene in the product, as shown in Example 6, the overall yield of ethylene and propylene can be greatly increased.

Example 7

An experiment was carried out on a pilot plant of a riser reactor, according to the scheme shown in FIG. 2, as follows:

1-octene feedstock was contacted with high-temperature catalytic conversion Catalyst i having a temperature of 750° C. at the bottom of a first reaction zone of the riser reactor for reaction under conditions including a reaction temperature of 700° C., a reaction pressure of 0.1 MPa, a reaction time of 5 seconds, and a weight ratio of the catalyst to the feedstock of 45:1.

Heavy oil I was mixed with the stream from the first reaction zone at the bottom of a second reaction zone of the riser reactor, and contacted with Heavy oil I and catalytic conversion Catalyst i for reaction under conditions including a reaction temperature of 530° C., a reaction pressure of 0.1 MPa and a reaction time of 6 seconds, and a weight ratio of the catalyst to Heavy oil I of 5:1.

The resulting reaction product was separated from the spent catalyst, the spent catalyst was regenerated by coke burning in a regenerator, and the regenerated catalyst was recycled to the bottom of the riser reactor; the reaction product (reaction product vapor) was separated to obtain ethylene, propylene, butylene, a first catalytic cracking distillate oil and a second catalytic cracking distillate oil.

The second catalytic cracking distillate oil was reacted with hydrogenation Catalyst iv under conditions including a temperature of 350° C., a hydrogen partial pressure of 18 MPa, a volume space velocity of 15 $h^{-1}$ and a hydrogen-to-oil volume ratio of 1500 to obtain a hydrogenation catalytic cracking distillate oil; the hydrogenated catalytic cracking distillate oil was mixed with the heavy feedstock oil and then recycled to the second reaction zone for further reaction.

The first catalytic cracking distillate oil was passed to an olefin separator, and a first olefin-containing stream (namely a stream comprising small molecular olefins) having a boiling point of less than 140° C. and a second olefin-containing stream (namely a stream comprising large molecular olefins) having a boiling point of more than 140° C. and less than 250° C. were obtained by separation; the first olefin-containing stream was recycled to the bottom of the first reaction zone I for further cracking; the second olefin-containing stream was introduced into the bottom of a third reaction zone III downstream of the second reaction zone II for further cracking under conditions including a reaction temperature of 530° C., and a reaction time of 5 seconds. The reaction conditions and product distribution are listed in Table 4.

Example 8

An experiment was carried out on a pilot plant of a riser reactor, according to the scheme shown in FIG. 3, as follows:

1-pentene feedstock was contacted with high-temperature catalytic conversion Catalyst i having a temperature of 750° C. at the bottom of a first reaction zone of the riser reactor for reaction under conditions including a reaction temperature of 700° C., a reaction pressure of 0.1 MPa, a reaction time of 5 seconds, and a weight ratio of the catalyst to the feedstock of 45:1.

Heavy oil I was mixed with the stream from the first reaction zone at the bottom of a second reaction zone of the riser reactor, and contacted with Heavy oil I and catalytic conversion Catalyst i for reaction under conditions including a reaction temperature of 530° C., a reaction pressure of 0.1 MPa and a reaction time of 6 seconds, and a weight ratio of the catalyst to Heavy oil I of 5:1.

Methanol was introduced into the second reaction zone downstream of the introduction position of Heavy oil I for reaction, under conditions including a reaction temperature of 500° C., a reaction pressure of 0.1 MPa, a reaction time of 3 seconds, and a weight ratio of the catalyst to methanol of 10:1.

The resulting reaction product was separated from the spent catalyst, the spent catalyst was regenerated by coke burning in a regenerator, and the regenerated catalyst was recycled to the bottom of the riser reactor; the reaction product was separated to obtain ethylene, propylene, butylene, a C5+ olefin-containing stream having an olefin content of 80 wt %, a second catalytic cracking distillate oil having a boiling point of more than 250° C., and the like.

The second catalytic cracking distillate oil was reacted with the hydrogenation Catalyst iv under conditions including a temperature of 350° C., a hydrogen partial pressure of 18 MPa, a volume space velocity of 15 $h^{-1}$ and a hydrogen-to-oil volume ratio of 1500 to obtain a hydrogenated catalytic cracking distillate oil.

The separated olefin-rich stream was recycled to the bottom of the first reaction zone for further cracking; and the hydrogenated catalytic cracking distillate oil is mixed with Heavy oil I and then recycled to the second reaction zone for further reaction. The reaction conditions and product distribution are listed in Table 4.

TABLE 4

| Reaction conditions and product distribution for Examples 7 and 8 | | |
|---|---|---|
| | Example 7 | Example 8 |
| First reaction zone | | |
| Catalyst | Catalyst i | Catalyst i |
| Temperature of regenerated catalyst, ° C. | 750 | 750 |

TABLE 4-continued

| Reaction conditions and product distribution for Examples 7 and 8 | | |
|---|---|---|
| | Example 7 | Example 8 |
| Feedstock | 1-octene/small molecule olefin | 1-pentene |
| Reaction temperature, ° C. | 700 | 700 |
| Catalyst-to-oil ratio | 45 | 45 |
| Reaction time, seconds | 5 | 5 |
| Second reaction zone | | |
| Feedstock | Heavy oil I | Heavy oil I/methanol |
| Reaction temperature, ° C. | 530 | 530/500 |
| Catalyst-to-oil ratio | 5 | 5/10 |
| Reaction time, seconds | 6 | 6/3 |
| Third reaction zone | | |
| Feedstock | Large molecular olefins | — |
| Reaction temperature, ° C. | 530 | |
| Catalyst-to-oil ratio | — | |
| Reaction time, seconds | 5 | |
| Hydrogenation unit | | |
| Catalyst | Catalyst iv | Catalyst iv |
| Temperature, ° C. | 350 | 350 |
| Hydrogen-to-oil volume ratio | 1500 | 1500 |
| Yield, wt % | | |
| Hydrogen + methane + ethane | 4.21 | 4.02 |
| Ethylene | 16.21 | 13.84 |
| Propylene | 27.06 | 25.34 |
| Butylene | 20.49 | 23.14 |
| Propane + butane | 4.29 | 4.01 |
| Benzene | 4.03 | 4.26 |
| Toluene | 2.22 | 1.64 |
| Xylene | 1.01 | 0.72 |
| Light oil | 17.46 | 19.25 |
| Coke | 3.02 | 3.78 |
| Total | 100.00 | 100.00 |
| Ethylene + propylene + butylene | 63.76 | 62.32 |

As can be seen from the data of Table 4, the methods of Examples 7 and 8 of the present application also provide a total yield of ethylene, propylene and butylene of 60% or more, and the total yield of ethylene and propylene is further improved as compared to Example 1, while significantly reducing the total yield of hydrogen, methane and ethane.

The present application is illustrated in detail hereinabove with reference to preferred embodiments, but is not intended to be limited to those embodiments. Various modifications may be made following the inventive concept of the present application, and these modifications shall be within the scope of the present application.

It should be noted that the various technical features described in the above embodiments may be combined in any suitable manner without contradiction, and in order to avoid unnecessary repetition, various possible combinations are not described in the present application, but such combinations shall also be within the scope of the present application.

In addition, the various embodiments of the present application can be arbitrarily combined as long as the combination does not depart from the spirit of the present application, and such combined embodiments should be considered as the disclosure of the present application.

The invention claimed is:

1. A fluidized catalytic conversion method for producing light olefins from hydrocarbons, comprises the following steps:

1) introducing an olefin-rich feedstock into a first reaction zone of a fluidized catalytic conversion reactor, contacting with a catalytic conversion catalyst having a temperature of 650° C. or higher, and reacting under first catalytic conversion conditions, wherein the olefin-rich feedstock has an olefin content of 50 wt % or more;

2) introducing a heavy feedstock into a second reaction zone of the fluidized catalytic conversion reactor downstream of the first reaction zone, contacting with the catalytic conversion catalyst from the first reaction zone after the reaction of step 1), and reacting under second catalytic conversion conditions;

3) separating an effluent of the fluidized catalytic conversion reactor to obtain a reaction product vapor and a spent catalyst, and separating the reaction product vapor to obtain ethylene, propylene, butylene, a first catalytic cracking distillate oil and a second catalytic cracking distillate oil; an initial boiling point of the first catalytic cracking distillate oil is in a range of more than 20° C. to less than 140° C., a final boiling point of the second catalytic cracking distillate oil is in a range of more than 250° C. to less than 550° C., and a cut point between the first catalytic cracking distillate oil and the second catalytic cracking distillate oil is in a range of 140° C. to 250° C.;

4) separating the first catalytic cracking distillate oil to obtain an olefin-rich stream having a C5+ olefin content of at least 50 wt %; and 5) recycling at least a part of the olefin-rich stream to step 1) for further reaction, wherein the first catalytic conversion conditions include:

a reaction temperature of 600-800° C.;

a reaction pressure of 0.05-1 MPa;

a reaction time of 0.01-100 seconds; and a weight ratio of the catalytic conversion catalyst to the olefin-rich feedstock of (1-200): 1; and the second catalytic conversion conditions include:

a reaction temperature of 400-650° C.;

a reaction pressure of 0.05-1 MPa;

a reaction time of 0.01-100 seconds; and a weight ratio of the catalytic conversion catalyst to the heavy feedstock of (1-100): 1, wherein the fluidized catalytic conversion method further comprises:

7) recycling at least a part of the butylene separated in step 3) to the catalytic conversion reactor upstream of a position at which the olefin-rich feedstock is introduced to contact with the catalytic conversion catalyst for reaction under third catalytic conversion conditions that include:

a reaction temperature of 650-800° C., a reaction pressure of 0.05-1 MPa, a reaction time of 0.01-10 seconds, and a weight ratio of the catalytic conversion catalyst to the butylene of (20-200):1.

2. The method according to claim 1, further comprising the steps of:

6) contacting the second catalytic cracking distillate oil with a hydrogenation catalyst for reaction under hydrogenation conditions to obtain a hydrogenated catalytic cracking distillate oil, and recycling the hydrogenated catalytic cracking distillate oil to the second reaction zone of the fluidized catalytic conversion reactor for further reaction.

3. The method according to claim 2, wherein the hydrogenation conditions include: a hydrogen partial pressure of 3.0-20.0 MPa, a reaction temperature of 300-450° C., a hydrogen-to-oil volume ratio of 300-2000, and a volume space velocity of 0.1-3.0 $h^{-1}$.

4. The method according to claim 1, further comprising the steps of:

2a) introducing an oxygen-containing organic compound into the second reaction zone of the fluidized catalytic conversion reactor to contact with the catalytic conversion catalyst therein for reaction under fourth catalytic conversion conditions including:

a reaction temperature of 300-550° C., a reaction pressure of 0.05-1 MPa, a reaction time of 0.01-100 seconds, and a weight ratio of the catalytic conversion catalyst to the oxygen-containing organic compound feedstock of (1-100):1.

5. The method according to claim 1, further comprising the step of:

8) regenerating the spent catalyst obtained by the separation in step 3) by coke burning to obtain a regenerated catalyst having a temperature of 650° C. or higher, and then recycling the regenerated catalyst to the fluidized catalytic conversion reactor upstream of the first reaction zone for use as the catalytic conversion catalyst.

6. The method according to claim 1, wherein the olefin-rich feedstock has an olefin content of 80 wt % or more.

7. The method according to claim 1, wherein the catalytic conversion catalyst comprises 1-50 wt % of a molecular sieve, 5-99 wt % of an inorganic oxide, and 0-70 wt % of a clay, based on the weight of the catalytic conversion catalyst;

the molecular sieve comprises one or more of a macroporous molecular sieve, a mesoporous molecular sieve and a microporous molecular sieve; and the catalytic conversion catalyst further comprises 0.1-3 wt % of a modifying element, based on the weight of the catalytic conversion catalyst, wherein the modifying element is one or more selected from the group consisting of Group VIII metals, Group IVA metals, Group V metals, and rare earth metals.

8. The method according to claim 2, wherein the hydrogenation catalyst comprises 20 to 90 wt % of a carrier, 10 to 80 wt % of a supported metal, and 0 to 10 wt % of an additive, based on the weight of the hydrogenation catalyst; and wherein the carrier is alumina and/or amorphous silica-alumina, the additive is selected from the group consisting of fluorine, phosphorus, titanium, platinum, and a combination thereof, and the supported metal is Group VIB metal, Group VIII metal, or a mixture thereof.

9. The method according to claim 1, wherein the olefin-rich stream obtained in step 4) has a C5+ olefin content of at least 80%.

10. The method according to claim 1, wherein the fluidized catalytic conversion reactor is-selected from a fluidized bed reactor and a riser reactor.

11. The method according to claim 4, wherein the oxygen-containing organic compound is fed to the second reaction zone of the fluidized catalytic conversion reactor after mixing with the heavy feedstock, or fed to the second reaction zone of the fluidized catalytic conversion reactor downstream of a position at which the heavy feedstock is introduced.

12. The method according to claim 1, wherein the first catalytic conversion conditions include:

a reaction temperature of 630-780° C.;

a reaction pressure of 0.1-0.8 MPa;

a reaction time of 0.1-80 seconds; and a weight ratio of the catalytic conversion catalyst to the olefin-rich feedstock of (3-180):1; and the second catalytic conversion conditions include:

a reaction temperature of 450-600° C.;

a reaction pressure of 0.1-0.8 MPa;

a reaction time of 0.1-80 seconds; and a weight ratio of the catalytic conversion catalyst to the heavy feedstock of (3-70):1.

13. The method according to claim 1, wherein the third catalytic conversion conditions include:

a reaction temperature of 680-780° C., a reaction pressure of 0.1-0.8 MPa, a reaction time of 0.05-8 seconds, and a weight ratio of the catalytic conversion catalyst to the butylene of (30-180):1.

14. The method according to claim 4, wherein the fourth catalytic conversion conditions include:

a reaction temperature of 400-530° C., a reaction pressure of 0.1-0.8 MPa, a reaction time of 0.1-80 seconds, and a weight ratio of the catalytic conversion catalyst to the oxygen-containing organic compound feedstock of (3-80):1.

15. The method according to claim 4, wherein the oxygen-containing organic compound comprises at least one selected from the group consisting of methanol, ethanol, dimethyl ether, methyl ethyl ether, and ethyl ether.

16. The method according to claim 1, wherein the olefin-rich feedstock has an olefin content of 90 wt % or more.

17. The method according to claim 1, wherein the olefin-rich feedstock is a pure olefin feedstock.

18. The method according to claim 1, wherein the olefins in the olefin-rich feedstock consist essentially of C5+ olefins.

19. The method according to claim 1, wherein the olefin-rich feedstock is at least one selected from the group consisting of a C5+ fraction produced by an alkane dehydrogenation device, a C5+ fraction produced by a catalytic cracking unit of an oil refinery, a C5+ fraction produced by a steam cracking unit of an ethylene plant, a C5+ olefin-rich byproduct fraction of an MTO process, and a C5+ olefin-rich byproduct fraction of an MTP process; and/or the heavy feedstock is selected from the group consisting of petroleum hydrocarbons and mineral oils; the petroleum hydrocarbon is selected from the group consisting of vacuum gas oil, atmospheric gas oil, coker gas oil, deasphalted oil, vacuum residuum, atmospheric residuum, heavy aromatic raffinate, and combinations thereof; the mineral oil is selected from the group consisting of coal liquefaction oil, oil sand oil, shale oil, and a combination thereof.

* * * * *